US008675027B2

(12) United States Patent
Nakano et al.

(10) Patent No.: US 8,675,027 B2
(45) Date of Patent: Mar. 18, 2014

(54) IMAGE DISPLAY APPARATUS

(75) Inventors: Nami Nakano, Tokyo (JP); Shuichi Kagawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 575 days.

(21) Appl. No.: 12/933,643

(22) PCT Filed: Apr. 28, 2010

(86) PCT No.: PCT/JP2010/003057

§ 371 (c)(1),
(2), (4) Date: Sep. 20, 2010

(87) PCT Pub. No.: WO2010/140299

PCT Pub. Date: Dec. 9, 2010

(65) Prior Publication Data

US 2011/0157244 A1 Jun. 30, 2011

(30) Foreign Application Priority Data

Jun. 3, 2009 (JP) ..... 2009-134107
Jul. 1, 2009 (JP) ..... 2009-156960
Jan. 20, 2010 (JP) ..... 2010-010097

(51) Int. Cl.
*G09G 5/10* (2006.01)

(52) U.S. Cl.
USPC ..... 345/690; 345/46; 345/63; 345/77; 345/90; 345/88

(58) Field of Classification Search
USPC ..... 345/46, 63, 77, 87–88, 90, 690
See application file for complete search history.

(56) References Cited

U.S. PATENT DOCUMENTS

2006/0192899 A1 8/2006 Ogita
2008/0231571 A1 9/2008 Krijn et al.
2009/0001251 A1* 1/2009 Ng et al. ..... 250/205
2009/0128451 A1 5/2009 Tokui
2009/0167193 A1 7/2009 Ogasawara et al.
2009/0231313 A1 9/2009 Teranishi et al.

FOREIGN PATENT DOCUMENTS

JP 2006-267995 A 10/2006
JP 2007-65177 A 3/2007

(Continued)

*Primary Examiner* — Abbas Abdulselam
*Assistant Examiner* — Shawna Stepp Jones
(74) *Attorney, Agent, or Firm* — Birch, Stewart, Kolasch & Birch, LLP

(57) ABSTRACT

There are provided a light source (1) having a plurality of light emitters, each of the light emitters, whose light-emission period is controlled separately, emitting one color of a plurality of colors; an image signal analyzer for analyzing an input image data, and determining a timing of light emission for each light emitter; a light source controller (5) for controlling the light-emission period for the light source based on the light-emission timing for each light emitter, such that the light-emission period is not shorter than a light-emission period of a predetermined minimum time length light-emission period; a light detector (6) for detecting the light emitted in the light-emission period of the minimum time length, and outputting the average light-emission peak values (Ir1, Ig1, Ib1); and a peak value corrector (7) for generating correction values (d_Ir, d_Ig, d_Ib) for controlling each of the average light-emission peak values (Ir1, Ig1, Ib1) to become equal to corresponding one in the reference peak values (tIr, tIg, tIb) stored in a memory (8). Even when the light-emission period is changed according to the input image, the color balance of the image is maintained constant.

10 Claims, 15 Drawing Sheets

(56) References Cited

FOREIGN PATENT DOCUMENTS

| | | | |
|---|---|---|---|
| JP | 2007-292823 | A | 11/2007 |
| JP | 2007-334313 | A | 12/2007 |
| JP | 2008-170768 | A | 7/2008 |
| JP | 2008-181044 | A | 8/2008 |
| JP | 2008-281707 | A | 11/2008 |
| JP | 2009-145585 | A | 7/2009 |
| WO | 2008/066040 | A1 | 6/2008 |

* cited by examiner

FIG.2(a)
| BRIGHTNESS | IMAGE DATA | | |
|---|---|---|---|
| | #1 | #2 | #3 |
| 0 | 0 | 0 | 0 |
| 1 | 1 | 0 | 0 |
| 2 | 0 | 1 | 0 |
| 3 | 1 | 1 | 0 |
| 4 | 0 | 0 | 1 |
| 5 | 1 | 0 | 1 |
| 6 | 0 | 1 | 1 |
| 7 | 1 | 1 | 1 |
FIG.2(b)
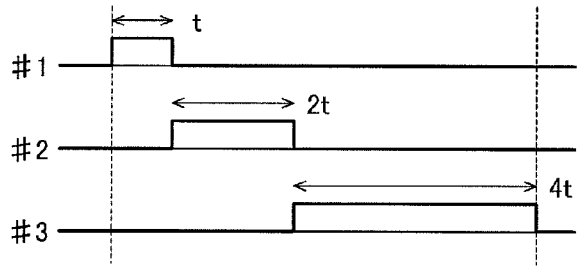
FIG.2(c)
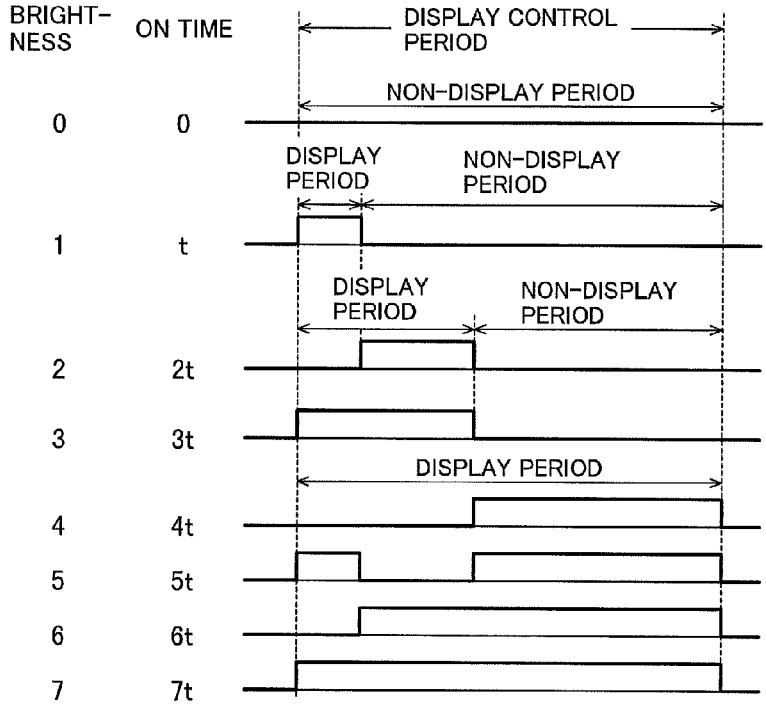

IMAGE DISPLAY APPARATUS

FIELD OF THE INVENTION

The present invention relates to an image display apparatus using an optical modulation device, and, in particular, to an image display technology for controlling light-emission periods of a light source according to the image.

BACKGROUND ART

In a conventional color image display apparatus of DLP (trademark) (Digital Light Processing) type using a single-plate type DMD (trademark) (Digital Micromirror Device) as an optical modulation device, tone is expressed by illuminating the DMD by light beams of three primary colors (e.g., of R, G and B), in a time-division manner, and varying ON/OFF time proportion of mirrors constituting pixels of the DMD, for each color.

In an image display apparatus using light sources of three primary colors (e.g., of R, G and B) as a backlight unit of the liquid crystal display panel serving as the optical modulation device, tone is expressed by turning on the light beams of the three primary colors in a time-division manner, and varying transmittance of each pixel of the liquid crystal display panel, for each color.

Generally, in these image display apparatuses, the light-emission period of the light source for each color and the light-emission peak value are constant regardless of the data value of the input image data. However, if the light source is made to emit light regardless of whether the image is dark or bright, the amount of light that is not necessary for the display may be increased, resulting in waste of energy and stray light.

As an improvement, it has been proposed to allot the light-emission period to each color depending on the magnitude of the input image data (brightness of the image) of each color, in an attempt to minimize the light emission of the light source, thereby to save energy, and to reduce stray light, and to increase the contrast of the image (e.g., Patent Document 1).

PRIOR ART REFERENCES

Patent Documents

Patent document 1: Japanese Patent Application Publication No. 2008-281707 (paragraphs 0008-0010)

SUMMARY OF THE INVENTION

Problems to be Solved by the Invention

However, when the light emission of the light emitter is controlled by means of a light-emission control signal which varies the light emission periods depending on the input image, the light emission peak value of light emitted by the light emitter may fluctuate because of characteristics, such as temperature characteristics, of the light emitter. As a result, actual amount of light emission may differ from control target, and the color balance may lose.

Moreover, when the light-emission period is shortened, it becomes difficult to detect the light emission intensity accurately, because of circuit noise and the like.

The present invention has been made to solve the problems discussed above, and its object is to provide an image display apparatus by which the light-emission period is controlled depending on the image without affecting the color balance of the image.

Means of Solution of the Problems

An image display apparatus according to an aspect of the invention comprises:

a light source having a plurality of light emitters, each of the plurality of light emitters, whose light-emission period is controlled separately, emitting one color of a plurality of colors;

an image signal analyzer for analyzing a plurality of color image data included in an input image, and for determining a timing of light emission for each of the plurality of light emitters;

a light source controller for generating light-emission drive signals based on the light emission timings for the respective plurality of light emitters, and for controlling light-emission periods of the light source;

an illuminating optical system for generating substantially uniform illumination light from the light emitted from each of the plurality of light emitters of one color of the plurality of colors;

an image display unit for modulating, pixel by pixel, the illumination light of the plurality of colors, to form a display image;

a light detector for detecting the light emitted from each of the plurality of light emitters of the light source, and for outputting an average light-emission peak value for each of the plurality of light emitters;

a reference peak value memory for storing, as reference peak values, reference values of the light-emission peak values for the respective light emitters; and a peak value corrector for generating a correction value for making so that the average light-emission peak value of each light emitter is equal to the corresponding reference peak value;

wherein the light source controller generates light-emission drive signals, each of the light-emission drive signals includes a fixed light-emission period of at least predetermined light emission time length, regardless of the values of the image data; and the light detector detects the light emitted during each of the fixed light-emission periods, and outputs the average light-emission peak value.

Effect of the Invention

According to an aspect of the invention, the light-emission drive signal includes a fixed light-emission period of at least a light-emission time length enabling accurate detection of the light-emission peak value, the light emitted in this fixed light-emission period is detected, and control is so made that the light-emission peak value is maintained constant, so that a stable, high image quality with little variation in the color balance in the image can be obtained.

BRIEF DESCRIPTION OF THE DRAWINGS

FIGS. 2(*a*) to 2(*c*) are diagrams for explaining an example of display control by a DMD.

MODES FOR CARRYING OUT THE INVENTION

Embodiment 1

Figure 1:
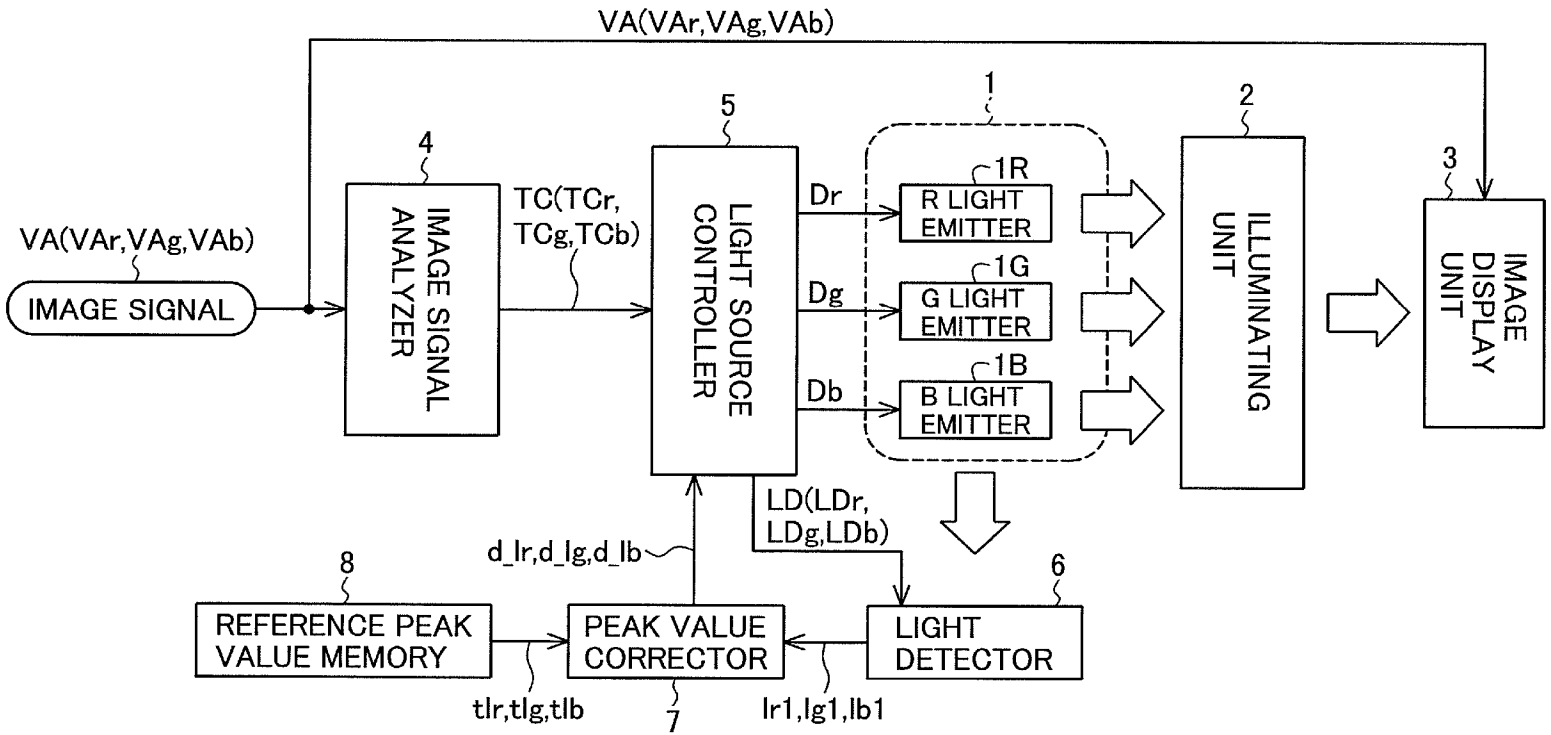
FIG. 1 is a block diagram showing configuration of an image display apparatus of Embodiment 1 of the present invention.

FIG. 1 is a block diagram showing configuration of an image display apparatus of Embodiment 1 of the present invention.

In FIG. 1, a light source 1 including a red light emitter (R light emitter) 1R, a green light emitter (G light emitter) 1G, and a blue light emitter (B light emitter) 1B emits illumination light. The illumination light is irradiated to an image display unit 3 substantially uniformly through an illuminating unit 2, and is modulated, pixel by pixel, to form a display image, by the image display unit 3, based on an image signal VA supplied from the outside.

An image signal analyzer 4 analyzes the image signal VA for each display image (each frame), and determines a timing of light emission (light-emission period and relative time point of the light emission) of each of the light emitters 1R, 1G, 1B, and outputs signals TC (TCr, TCg, TCb) indicating the timings of light emission.

A light source controller 5 sets the periods in which one of the light-emission drive signals Dr, Dg, Dv should be ON, based on the timings of light emission of the light emitters 1R, 1G, 1B output from the image signal analyzer 4, and controls the light emitters 1R, 1G, 1B of the light source 1 to emit light in accordance with the light-emission drive signals Dr, Dg, Db.

Each peak value of each light-emission drive signal Dr, Dg, Db is corrected by each corrective addition value d_Ir, d_Ig, d_Ib output from a peak value corrector 7.

The light source controller 5 also outputs, to a light detector 6, light-detection period signals LDr, LDg, LDb representing periods in which the light emission intensity of each light emitter is to be detected, in synchronism with each light-emission drive signal Dr, Dg, Db.

The light detector 6 detects the light emission intensity of each illumination light emitted from each light emitter 1R, 1G, 1B, and outputs each average light-emission peak value Ir1, Ig1, Ib1 for each of the light emitters 1R, 1G, 1B.

The peak value corrector 7 generates corrective addition values d_Ir, d_Ig, d_Ib such that the average light-emission peak values Ir1, Ig1, Ib1 output from the light detector 6 and the reference peak values tIr, tIg, tIb output from a reference peak value memory 8 are equal to each other, respectively.

In the following, description is made of a projection-type image display apparatus in which the image display unit 3 uses a DMD as a display device. The image display unit 3 includes the DMD (not shown), a projection screen (not shown), and an optical system (not shown) for projecting the light modulated by the DMD onto the projection screen. The illuminating unit 2 is an optical system for illuminating the DMD.

The image display apparatus is supplied with an image signal. The image signal VA is generated with a prerequisite that light beams of basic colors are synthesized by the display unit to display an image. In the following, description is made of a case in which the basic colors are red, green and blue.

The image signal VA includes color image data R(x,y) indicating the red data value, color image data G(x,y) indicating the green data value, and color image data B(x,y) indicating the blue data value, for each pixel (x, y) in the image formed by the image display unit 3.

Lasers or LEDs (light emitting diodes) emitting light beams of red, green and blue may be used as the light emitters 1R, 1G and 1B of the light source 1. The DMD displays image by controlling the brightness of each pixel by proportion of ON/OFF time of the micromirrors provided in the same number as the number of pixels of the image to be displayed. For simplicity of description, FIGS. 2(*a*) to 2(*c*) show an example of display control over the DMD for a case in which the image data are of 3 bits. FIG. 2(*a*) shows the brightness of the image for the image data with the respective bits #1 (least significant bit) to #3 (most significant bit); FIG. 2(*b*) shows the ON periods corresponding to the bits #1 to #3 (the periods in which the micromirrors of the DMD are ON, corresponding to the respective bits); and FIG. 2(*c*) shows the display control signal corresponding to the brightness 0 to 7.

The image signal analyzer 4 controls the timing of light emission for each light emitter, using the input image data VA. If the timing of light emission is so controlled that the light is not emitted in the period when the DMD is off for all the pixels in the screen (all the pixels in each frame), then it is possible to reduce unnecessary light emission.

As shown in FIG. 2(*c*), where the micromirrors of the DMD are ON/OFF-controlled in the order of data from the low-tone side of the display control signal, when the tone value is not more than "3", it is possible to separate the display period (in which any of the micromirrors is ON) for controlling the brightness of each pixel by turning ON/OFF of the micromirror, and the non-display period in which all the micromirrors are completely OFF, by placing the display period in the earlier part of the display control period, and non-display period in the later part of the display control period. The illumination light in the non-display period is not utilized, and may act as stray light causing decrease of the contrast. Accordingly, it is desirable to suspend the light emission in the non-display period.

FIGS. 2(*a*) to 2(*c*) show an example in which the image data are of three bits. Where the image data are of eight bits, if a length of time for displaying only the least significant bit (a length of the ON section, i.e., a time length, corresponding to the least significant bit) is represented by t, the length of the ON period corresponding to the maximum value of the image data is represented by 255*t*.

If all the most significant bit of the image data is "0" for all the pixels in each frame, the light emission can be suspended for the time length allotted to the most significant bit (ON section corresponding to the most significant bit) 128*t*, and the light-emission period can be reduced to half. If two most-significant bits are all zero, the light-emission period can be reduced to ¼. When only the least significant bit is to be displayed, the time length of the light-emission drive signals Dr, Dg, Db for displaying only the least significant bit may be as short as 1/255 of the maximum length.

In this way, the image signal analyzer 4 determines the optimum light-emission period for each light emitter 1R, 1G, 1B, based on each input color image data of each frame, and outputs the light-emission timing signals TCr, TCg, TCb so that the light-emission period is a necessary minimum.

The light source controller 5 outputs the light-emission drive signals Dr, Dg, Db, based on the light-emission timing signals TCr, TCg, TCb output from the image signal analyzer 4, for the respective light emitters 1R, 1G, 1B. As a result, the light-emission periods for the respective light emitters 1R, 1G, 1B will be different from each other.

The image display unit 3 generates an image by controlling the ON/OFF of the DMD using each color image data.

As described above, if the ON/OFF control signals for the micromirrors of the DMD are so set that the display period and the non-display period are separated, the light-emission drive signals Dr, Dg, Db can be made short, provided that the display period of the DMD is included. That is, since the timing of light emission is determined so as to include the display period of the DMD, based on the input image data VA, by the image signal analyzer 4, it is possible to control the light-emission period of the light emitters 1R, 1G, 1B to have a necessary minimum length, and to reduce the generation of the stray light.

Here, when the lasers or LEDs are set to emit light, at a fixed cycle, even if the peak values of the light-emission drive signals Dr, Dg, Db are constant, the light-emission peak values may vary, because of the characteristics of the individual light emitter or the light-emission period. If the relationship between the peak values of the light-emission drive signals Dr, Dg, Db and the actual light emission peak values is changed for different length of light-emission period, the color balance of the illumination light may vary, and the color change or coloring in the displayed image may be occurred. For this reason, the light detector 6 is used to detect the light emission intensity of the illumination light emitted from each of the light emitters 1R, 1G, 1B, and the peak value corrector 7 is used to correct the peak value of each of the light-emission drive signals Dr, Dg, Db output from the light source controller 5, such that the average light-emission peak values Ir1, Ig1, Ib1 are equal to the respective reference peak values tIr, tIg, tIb output from the reference peak value memory 8.

When the image is particularly dark (the maximum value of the image signal is small), the length of each of the light-emission drive signals Dr, Dg, Db can be shortened. When, however, the light-emission period is short, the light emission intensity detected by the light detector 6 may become insufficient, and the detected value may be easily affected by the disturbances such as circuit noises, and accurate detection of the light-emission peak value may become difficult. For this reason, the minimum length of the light-emission period is decided to be such length that the effects of the circuit noise and the like are small enough not to cause practical problem, and the light-emission peak value in the light-emission period of the minimum length is detected by the light detector 6.

Figure 3:
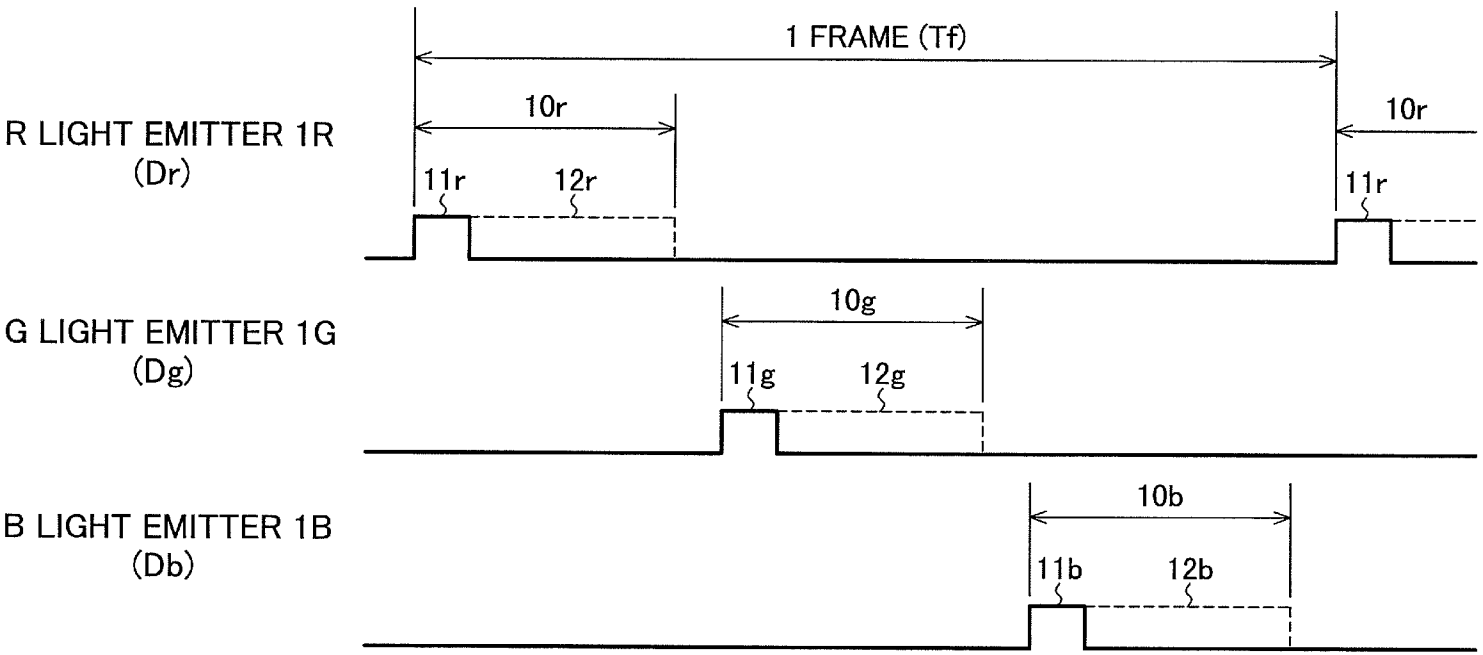
FIG. 3 is a diagram for explaining light-emission control of a light source in Embodiment 1.

Taking FIG. 3 as an example, description is made of the light-emission periods in one frame of the respective light emitters 1R, 1G, 1B, controlled by the light source controller 5. The light source controller 5 outputs the light-emission drive signals Dr, Dg, Db, based on the length of the light-emission timing signals TCr, TCg, TCb output from the image signal analyzer 4, for the respective light emitters 1R, 1G, 1B.

Each light-emission period 10*r*, 10*g*, 10*b* of each light-emission drive signal Dr, Dg, Db includes corresponding one of fixed light-emission periods 11*r*, 11*g*, 11*b* which are constant regardless of the value of the image data for each frame, and corresponding one of variable light-emission periods 12*r*, 12*g*, 12*b* which vary depending on the image data of each frame (in particular, the maximum value of the image data within the frame), and if the length of one of the light-emission timing signals TCr, TCg, TCb is not less than the fixed light-emission periods 11*r*, 11*g*, 11*b*, the corresponding one of the light-emission drive signals Dr, Dg, Db having the time length of the light-emission timing signals TCr, TCg, TCb is output, while if the length of one of the light-emission timing signals TCr, TCg, TCb is smaller than the fixed light-emission period, the corresponding one of the light-emission drive signals Dr, Dg, Db having the length of the fixed light-emission periods 11*r*, 11*g*, 11*b* is output.

The lengths of the fixed light-emission periods 11*r*, 11*g*, 11*b* may differ from each other. This is because there are situations in which the light emission characteristics, in particular, the minimum time length enabling accurate detection of the light emission peak value may differ depending on the kind (color) of the light emitters 1R, 1G, 1B.

In the image display apparatus of the present embodiment, each light-emission period 10*r*, 10*g*, 10*b* of each light emitter 1R, 1G, 1B is so controlled that light is not emitted in the period which does not contribute to displaying an image (the period in which the display control signal is OFF for all the pixels within the frame) according to the value of each input color image data, and so that when the input image is bright (the maximum value of the image signal is large), each light-emission period 10*r*, 10*g*, 10*b* of each light-emission drive signal Dr, Dg, Db is long, while when the input image is dark (the maximum value of the image signal is small), each light-emission period 10*r*, 10*g*, 10*b* is short.

Thus, in the period provided for the light emission, a turn-off period in which light is not emitted from each light emitter 1R, 1G, 1B is provided, according to the image, so that stray light and decrease in contrast can be reduced, compared with the case where the light is kept emitting.

The light detector 6 detects the time integral of the intensity of light emitted from each light emitter 11*r*, 11*g*, 11*b*, during the fixed light-emission period, in synchronism with the corresponding fixed light-emission period 11*r*, 11*g*, 11*b* output from the light source controller 5, and thereby detects and outputs the average light-emission peak values Ir1, Ig1, Ib1 which are averages of the light-emission peak value over the fixed light-emission periods 11*r*, 11*g*, 11*b*.

The peak values which are used as control targets are stored in the reference peak value memory 8, as reference peak values tIr, tIg, tIb. The detected peak value of each light emitter detected by a sensor of the light-emission amount detector 6 when the color balance is adjusted at the time of manufacturing of the image display apparatus, for instance, may be stored as the reference peak values tIr, tIg, tIb.

To the peak value corrector 7, the reference peak values tIr, tIg, tIb from the reference peak value memory 8, and the average light-emission peak values Ir1, Ig1, Ib1 output from the light detector 6 are input. The peak value corrector 7 first compares the average light-emission peak values Ir1, Ig1, Ib1 and the respective reference peak values tIr, tIg, tIb, and outputs ratios between these peak values. As the peak value ratios, ratios of the reference peak values tIr, tIg, tIb to the respective average light-emission peak values Ir1, Ig1, Ib1 are determined by calculation.

The calculation for determining the above mentioned "ratio" is made for each color, as can be expressed by the following equations:

$$Idr=tIr/Ir1$$

$$Idg=tIg/Ig1$$

$$Idb=tIb/Ib1 \quad (1)$$

The relationship between the average light-emission peak values and the correction values may be stored in a table. And referring to the table may be used.

Next, the ratios Idr, Idg, Idb determined using the detected value of the sensor, are converted to corrective addition values d_Ir, d_Ig, d_Ib representing the magnitude of the current driving the light emitter, and output to the light source controller 5. The conversion may be performed, by determining, in advance, the relationship between the light emission drive signal for causing the light emitter to emit light, and the light emission peak value detected by the light detector 6, and by determining the corrective addition value by calculation.

Instead of calculating the peak value ratios Idr, Idg, Idb, and then making the above conversion, a table storing the corrective addition values corresponding to the ratios between the reference light-emission value and the average light-emission peak value may be provided, and the corrective addition value may be read.

The light source controller 5 stores, internally, the peak value of the light-emission drive signals Dr, Dg, Db of the preceding frame, as drive peak values o_Ir, o_Ig, o_Ib, and generates light-emission waveforms with their peak values being equal to the respective drive peak values o_Ir, o_Ig, o_Ib, based on the light-emission timing signals TCr, TCg, TCb output from the image signal analyzer 4, and corrects the peak value of the light-emission waveforms using the corrective addition values d_Ir, d_Ig, d_Ib, to generate the light-emission drive signals Dr, Dg, Db.

The light source controller 5 also stores, internally, the peak values which are used as control references, as reference drive peak values sIr, sIg, sIb, and uses the reference drive peak values sIr, sIg, sIb in place of the drive peak values o_Ir, o_Ig, o_Ib, when the light-emission drive signals Dr, Dg, Db are generated at the beginning (e.g., immediately after the power supply to the image display apparatus is initially turned on).

For instance, the peak values of the control signal (drive signal) input to each light emitter immediately after the color balance is adjusted at the time of manufacturing of the image display apparatus, for example, are stored and used, as the reference drive peak values sIr, sIg, sIb.

The correction using the corrective addition value is performed such that, when the corrective addition value is smaller than 1 (unity), the peak value of the light-emission drive signal is decreased, while when the corrective addition value is larger than 1, the peak value of the light-emission drive signal is increased. The peak value thus increased or decreased is maintained at the same value as long as the corresponding corrective addition value d_Ir, d_Ig, d_Ib is 1.

The calculation for determining the peak value of the light emission drive signal at the light source controller 5 is also performed for each color.

As has been described, even when the light-emission period varies widely, each light emitter is made to emit light for a light-emission period which is equal to or longer than a constant light-emission periods (one of fixed light-emission periods 11*r*, 11*g*, 11*b*), and the light-emission peak value of each light emitter is detected in the fixed light-emission period. As a result, the light-emission peak value can be accurately detected and controlled, and the color balance of the image is adjusted to be constant, even when the light-emission period is varied.

In the above example, the correction value generated based on the ratio between the average light-emission peak value and the reference peak value is converted to the corrective addition value, and the reference drive peak value increased or decreased according to the corrective addition value is used as the peak value of the light-emission drive signal. Alternatively, the peak value of the light-emission drive signal may be increased or decreased based on the difference between the average light-emission peak value and the reference peak value. In this case, when the difference obtained by subtracting the reference peak value from the average light-emission peak value is positive, the peak value of the light-emission drive signal is decreased, while when the above difference is negative, the peak value of the light-emission drive signal is increased.

For instance, the peak value Hr(t) of the light-emission drive signal in each frame may be determined based on the peak value Hr(t−1) of the light-emission drive signal for the preceding frame, and the average light-emission peak value Ir1(*t*−1), by calculation represented by the following equation.

The calculation for determining the peak value of the light-emission drive signal is represented by the following equation.

$$Hr(t)=Hr(t-1)+\beta\times\{Ir1(t-1)-tIr\} \quad (2)$$

Here, β represents a gain (including the rate of conversion from the difference in the peak value to the difference in the drive current).

Moreover, the detection of the average light-emission peak value, and the adjustment of the peak value of the light-emission drive current based on the detection may be performed every frame, or once in a plurality of frames. Moreover, an average value of the peak value over a plurality of frames may be used as the average light-emission peak value.

Embodiment 2

In the image display apparatus of Embodiment 1 described above, one frame period is equally divided and allotted to the light-emission period for each light emitter. In the image display apparatus of Embodiment 2, the light-emission period for each light emitter is allotted in proportion of each color of the image signal. The configuration of the image display apparatus of Embodiment 2 is identical to that of Embodiment 1 as shown in FIG. 1.

Figure 4:
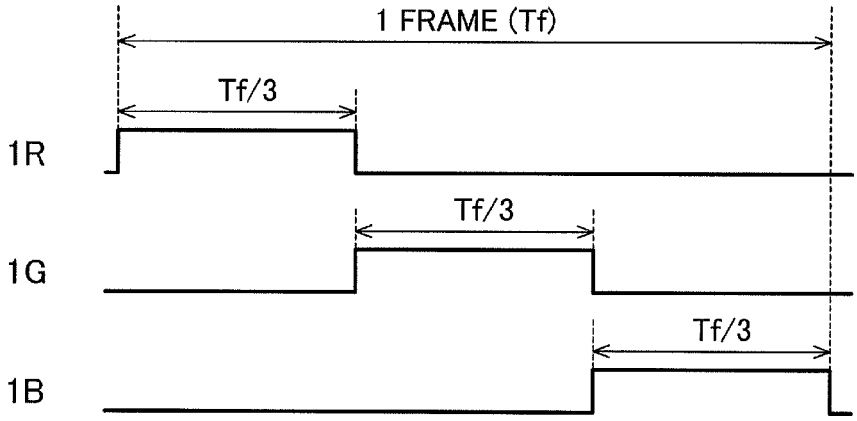
FIG. 4 is a diagram for explaining light-emission control in the case where the light-emission periods of the light source are equal.

As shown in FIG. 4, if the light-emission period and the light-emission peak value for each color light source 1R, 1G, 1B are always constant regardless of each color image data, and each light emitter is made to emit light according to a drive signal, produced by equally dividing and allocating one frame period (Tf) to the light-emission period for each light emitter, the light-emission period for each light emitter will, at most, be ⅓ of the one frame period.

However, in actual image data, proportions of all colors are rarely equal. Accordingly, equal allocation to the light-emission periods for the respective light emitters will result in unnecessary light-emission period. Conversely, if the allocation is made so that the light-emission period for each light emitter is in accordance with the proportion of each color in the image signal, it is possible to reduce the unnecessary light-emission period, and increase the brightness of the image.

Figure 5A:
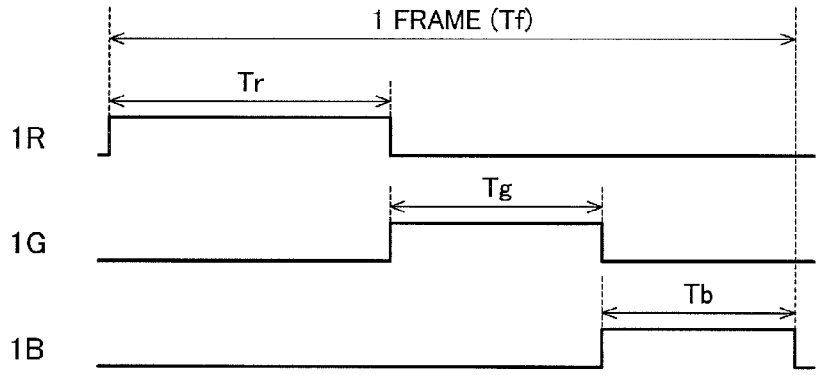
FIGS. 5(*a*) to 5(*c*) are diagrams for explaining an example of a method for controlling the light-emission period of the light source for each light emitter.
Figure 5B:
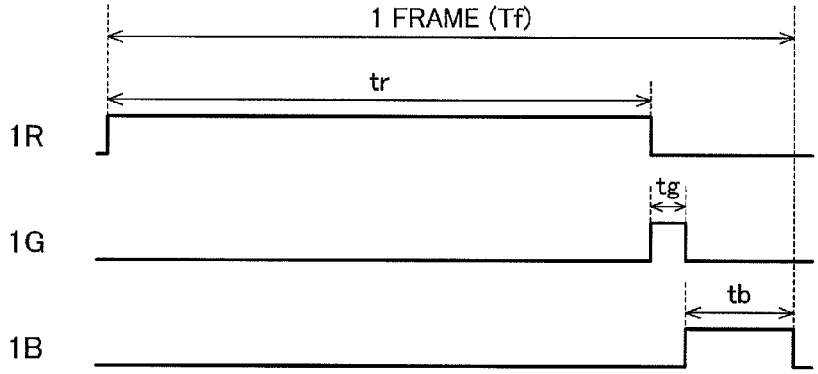
Figure 5C:
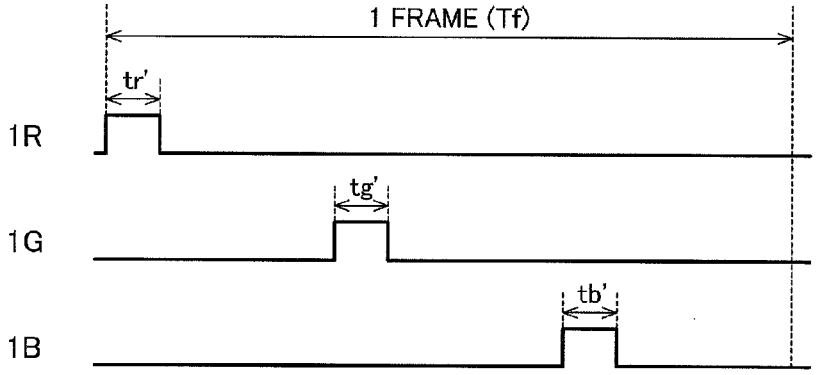

We explain about an example in which the timing of light emission by each light emitter 1R, 1G, 1B within one frame period is controlled for each light emitter, according to the input image data of each color, as shown in FIG. 5(*a*). Each light-emission period Tr, Tg, Tb for each light emitter 1R, 1G, 1B is controlled within the range of one frame Tf, and the proportion of the light-emission period of each light emitter varies depending on the input image data of each color. Since the light-emission period for each light emitter is controlled so that Tr+Tg+Tb≤Tf is satisfied, a light emission control by which a light-emission period exceeds ⅓ of one frame is possible. That is, by controlling so that one of the light emitters emit light throughout the one frame period, maximum utilization of each frame is possible, and displaying brighter image is therefore possible.

For instance, in the case of an image in which red is dominant, the light-emission period Tr for the light emitter 1R is made long as indicated by a reference mark tr, as shown in FIG. 5(*b*), and the light-emission periods Tg, Tb for the light emitter 1G, 1B are shortened as indicated by reference marks tg, tb. In this way, the light source is permitted to emit light to the maximum degree, and unnecessary light emission is eliminated. When the image is dark (the maximum value of the image signal is small), the light-emission periods Tr, Tg, Tb for the respective light emitters 1R, 1G, 1B are shortened as shown by reference marks tr', tg', tb' in FIG. 5(*c*), and unnecessary light emission can be eliminated.

As has been described, the timing of the light emission is controlled, such that light is not emitted in the period when the DMD is OFF for all the pixels, and the proportion of the light emission of each light emitter is controlled according to the image, utilizing one frame period, so that it is possible to control the light-emission periods for the light emitters 1R, 1G, 1B to be at a necessary minimum while making a maximum utility of one frame period, and to provide an image display apparatus with reduced stray light.

Thus, the light-emission period for each light emitter can be shortened according to the input image, as shown in FIGS. 5(*b*) and 5(*c*). However, when the light-emission period becomes short, the light emission intensity detected by the light detector 6 become insufficient, and becomes easily affected by disturbances, such as circuit noise, and accurate detection of the light-emission peak value becomes difficult. For this reason, the fixed light-emission period is decided to have such length that the effects such as the circuit noise or the like are small enough not to cause practical problem, and the light-emission peak value in the fixed light-emission period is detected by the light detector 6.

When lasers, LEDs, or the like are made to emit light intermittently, while maintaining the peak values of the light-emission drive signals Dr, Dg, Db constant, having a plurality of light-emission pulses, within a range of several tens of milliseconds (1 frame), peak values of the plurality of pulses vary together. In the present image display apparatus, the light emitter is made to emit light within one frame, being divided into the fixed light-emission period and the light-emission period which varies according to the image. The light-emission peak values in both of the light-emission periods vary together, so that the average-emission peak value detected in the fixed light-emission period by the light detector 6 can be estimated as representing the average light-emission peak values Ir1, Ig1, Ib1 over the entire light-emission period within the one frame.

Figure 6:
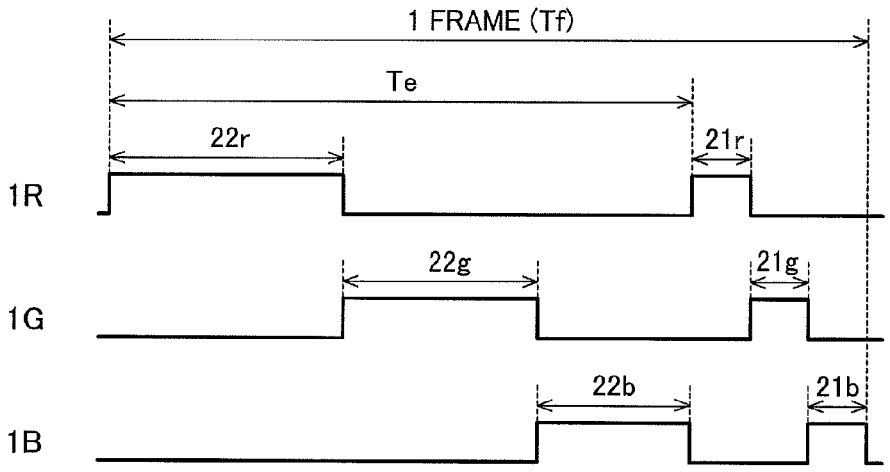
FIG. 6 is a diagram for explaining an example of light-emission control of the light source in Embodiment 2.

Taking FIG. 6 as an example, description is made of the light-emission period in one frame for each light emitter 1R, 1G, 1B controlled by the light source controller 5. The light source controller 5 outputs, for each of the light emitters 1R, 1G, 1B, each light-emission drive signal Dr, Dg, Db which is ON for each light-emission period Tr, Tg, Tb consisting of the light-emission period 22*r*, 22*g*, 22*b*, based on the time length of each light-emission timing signal TCr, TCg, TCb output from the image signal analyzer 4, and the fixed light-emission period 21*r*, 21*g*, 21*b*, of a time length constant regardless of each color image data.

Each fixed light-emission period 21*r*, 21*g*, 21*b* for each light emitter has such length that the effects such as the circuit noise or the like are small enough not to cause practical problem, and always has the same time length for each light emitter, regardless of the value of each color image data. The lengths of the variable light-emission periods 22*r*, 22*g*, 22*b* for the light emitters are controlled within period Te, which is one frame period not including the fixed light-emission periods (21*r*+21*g*+21*b*), and the proportion of the light-emission period for each light emitter is varied according to the input image. In the image display unit 3, the light emission during the fixed light-emission period 21*r*, 21*g*, 21*b* does not cause display of the image onto the projection screen.

For instance, when a DMD is used as the image display unit 3 in the projection-type image display apparatus, the DMD is switched between an ON state in which the light is projected onto the projection screen according to the image data, during the variable light-emission period, and the OFF state in which the light is not projected. In the fixed light-emission period, the DMD is kept in the OFF state.

Here, by controlling such that the fixed light-emission periods which are not dependent on each color image data appear separately for all light emitters, it is unnecessary to provide a plurality of sensors for detecting the light-emission peak values, but a single sensor which is provided at a position where it can detect the light of the light emitters 1R, 1G, 1B may be used to detect the light-emission peak value for each light emitter.

The light source controller 5 outputs the light-emission drive signals Dr, Dg, Db based on the light-emission timing signals TCr, TCg, TCb, for each of the light emitters 1R, 1G, 1B, output from the image signal analyzer 4. As a result, the light-emission periods Tr, Tg, Tb for the light emitters 1R, 1G, 1B are different from each other. The image display unit 3 generates the image by controlling ON/OFF of the DMD, pixel by pixel, using the image data.

In the image display apparatus of the present embodiment, the light-emission period for each light emitter is controlled according to the input image data of each color. As a result, the light-emission periods of the light-emission drive signals Dr, Dg, Db are long when the input image are bright (the maximum value of the image signal is large), while the light-emission periods of the light-emission drive signals Dr, Dg, Db are short when the image is dark (the maximum value of the image signal is small). As shown in FIG. 6, a turn-off period in which emission of light according to the image is not made is provided for each light emitter, it is possible to reduce the stray light and the decrease of the contrast, compared with the case where the light is kept emitting.

The light detector 6 detects the time integral of the intensity of the light emitted from the light emitters 1R, 1G, 1B, during the fixed light-emission period 21*r*, 21*g*, 21*b*, and thereby outputs the average light-emission peak values Ir1, Ig1, Ib1, which are the averages of the light-emission peak values over the fixed light-emission period. The peak values used as control targets are stored in the reference peak value memory 8 as the reference peak values tIr, tIg, tIb. The peak value corrector 7 outputs the corrective addition values d_Ir, d_Ig, d_Ib from the ratios between the average light-emission peak values Ir1, Ig1, Ib1 and the reference peak values tIr, tIg, tIb. The light source controller 5 generates drive signals which are generated at the same timing as the light-emission timing signals TCr, TCg, TCb are generated, and which have the peak values increased or decreased by the corrective addition values d_Ir, d_Ig, d_Ib. These operations are similar to those in Embodiment 1, and their detailed description is omitted.

With regard to the control of the peak value of the light-emission drive signal, the variations described in Embodiment 1 can be applied.

Because the image display apparatus of the present embodiment operates as described above, and each light-emission peak value is detected in the fixed light-emission period, in the light-emission control method for modulating the light-emission period according to the image, the light-emission peak value can be detected and controlled accurately, and the color balance of the image can be adjusted to be constant despite the change in the light-emission period.

Embodiment 3

In the image display apparatus of Embodiment 3 of the present invention, the light emission in the fixed light-emission period which is not used in the image display unit in the Embodiment 2, is also used for displaying an image. In Embodiment 3, the image display apparatus 3 controls ON/OFF of the DMD in the light-emission period within one frame, which is a combination of the variable light-emission period and the fixed light-emission period. For instance, when the image is dark (the maximum value of the image signal is small), the DMD is turned OFF in the fixed light-emission period so that the light emission in the fixed light-emission period is not used as in Embodiment 2, while when the image is bright (the maximum value of the image signal is large), the DMD is turned ON, and the light emission in the fixed light-emission period is used for displaying an image, thereby enhancing the contrast. The image display unit 4 controls the timing of light emission for each light emitter, using the input image data of each color. The light source controller 5 outputs the light-emission drive signals Dr, Dg, Db to which the fixed light-emission period has been added, based on the light-emission timing signals TCr, TCg, TCb output from the image signal analyzer 4.

As has been described, the fixed light-emission period in which the DMD (trademark) is kept OFF and which is not used for displaying an image onto the projection screen in the image display unit 3 in Embodiment 2, is used as part of the image display period, and the light emission in the fixed light-emission period is used for displaying an image. Consequently, the utilization efficiency of the illumination light is improved compared with Embodiment 2. As a result, it is possible to increase luminance and improve contrast, without changing the power consumption of the light source.

Embodiment 4

Figure 7:
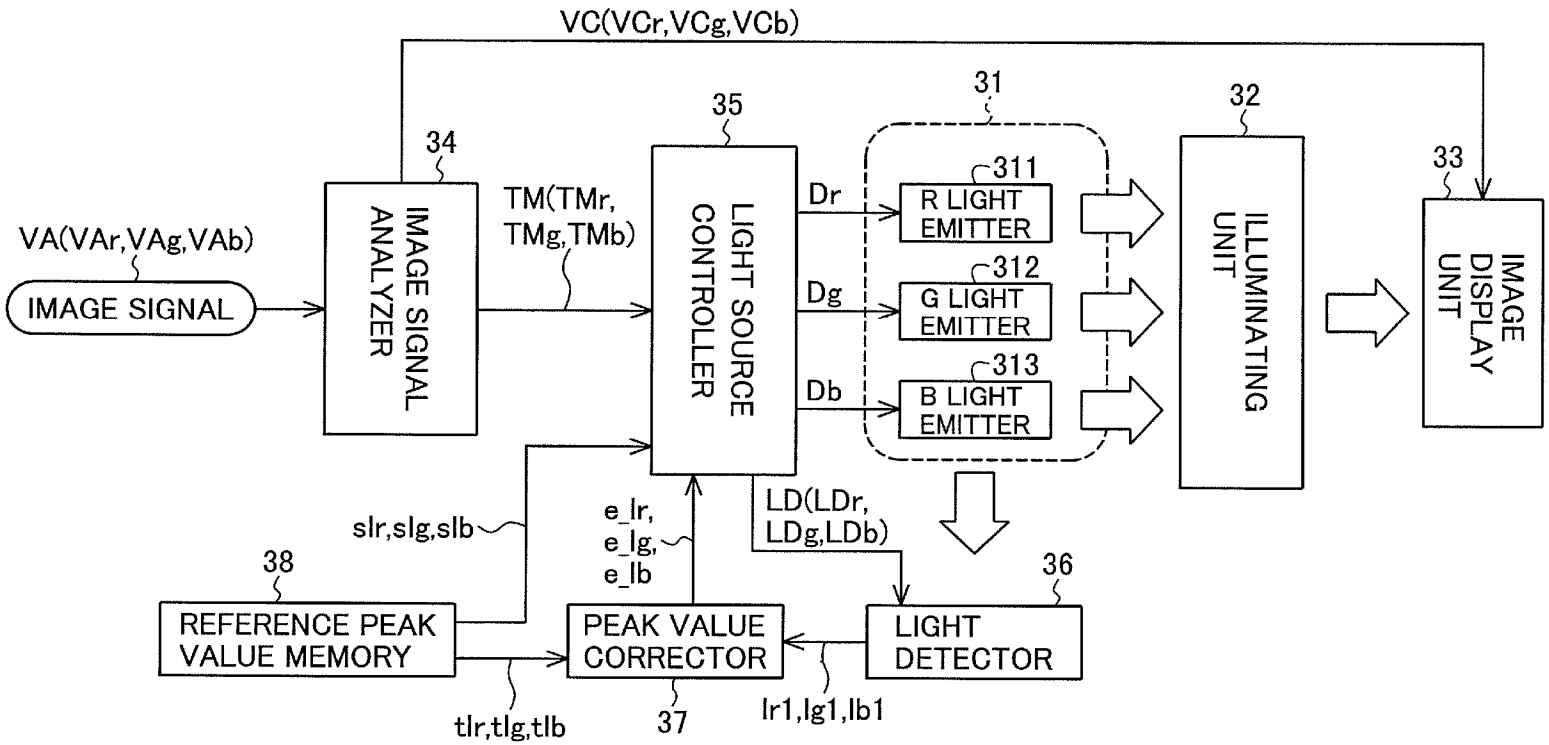
FIG. 7 is a block diagram showing the configuration of the image display apparatus of Embodiment 4.

FIG. 7 is a block diagram showing the configuration of the image display apparatus of Embodiment 4 of the present invention. In FIG. 7, the image display apparatus includes an image signal analyzer 34, a light source controller 35, a light source 31 having a red light emitter (R light emitter) 311, a green light emitter (G light emitter) 312, and a blue light emitter (B light emitter) 313, and an illuminating unit 32, an image display unit 33, a light detector 36, a peak value corrector 37, and a reference peak value memory 38.

In the following description, the present image display apparatus is assumed to be applied to a liquid crystal display panel of the backlight type, in which the transmittance or reflectivity of the illumination light is controlled, pixel by pixel, to generate a display image.

The image signal analyzer 34 analyzes each color image data VAr, VAg, VAb included in the input image data VA, and sets the light-emission period for each light emitter (311, 312, 313), corresponding to each color image data, and outputs, to the light source controller 35, the light-emission period control signal TM formed of the light-emission period control signals TMr, TMg, TMb for the respective light emitters representing the light-emission periods that have been set.

The image signal analyzer 34 also corrects each color image data in association with the light-emission period of each light emitter 311, 312, 313, and outputs, to the image display unit 33, the display image signal VC formed of corrected color display image data VCr, VCg, VCb.

The light source controller 35 generates light-emission drive signals Dr, Dg, Db for causing the respective light emitters 311, 312, 313 to emit light, based on the light-emission period control signals TMr, TMg, TMb output from the image signal analyzer 34, and outputs the light-emission drive signals Dr, Dg, Db to the respective light emitters 311, 312, 313, and stores the peak values of the light-emission drive signals Dr, Dg, Db as drive peak values o_Ir, o_Ig, o_Ib. The peak values of the light-emission drive signals Dr, Dg, Db are determined from the peak value correction signals e_Ir, e_Ig, e_Ib output from the peak value corrector 37, and the drive peak values o_Ir, o_Ig, o_Ib stored in the light source controller 35, such that each light emitter 311, 312, 313 emits light with a predetermined light emission intensity.

The light source controller 35 outputs, to the light detector 36, light-detection period signals LDr, LDg, LDb each representing the period in which the light emission of each light emitter 311, 312, 313 is detected, in synchronism with each light-emission drive signal Dr, Dg, Db.

Figures 8A, 8B, 8C:
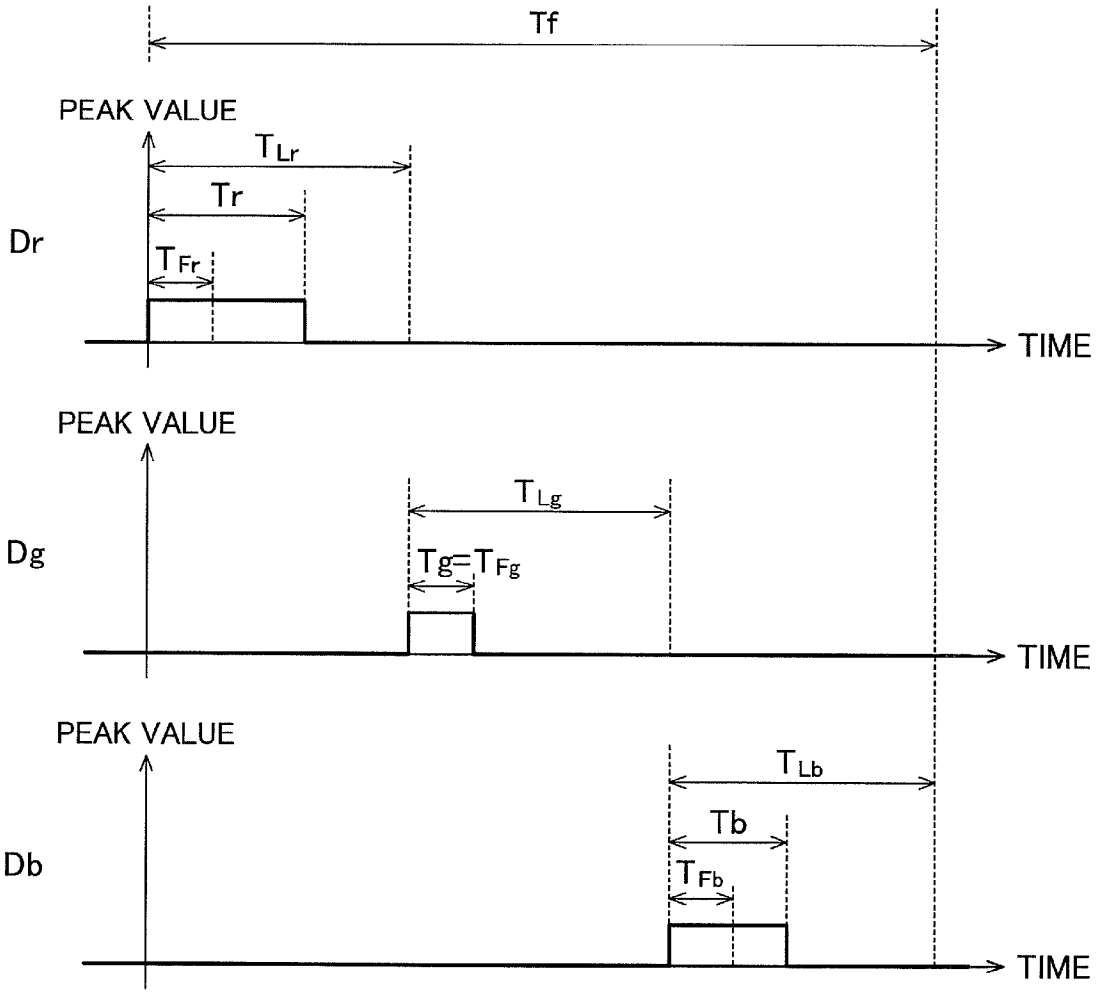
FIGS. 8(*a*) to 8(*c*) are waveform diagrams showing examples of the light-emission drive signals Dr, Dg, Db in one frame period in the image display apparatus of Embodiment 4.

FIGS. 8(*a*) to 8(*c*) are waveform diagrams showing an example of the light-emission period control signals TMr, TMg, TMb in one frame period Tf, supplied to the respective light emitters 311, 312, 313 from the light source controller 35.

FIG. 8(*a*) shows the waveform of the light-emission drive signal Dr supplied to the light emitter 311, FIG. 8(*b*) shows the waveform of the light-emission drive signal Dg supplied to the light emitter 312, and FIG. 8(*c*) shows the waveform of the light-emission drive signal Db supplied to the light emitter 313.

In FIGS. 8(*a*) to 8(*c*), the period in the first one-third of one frame period Tf is set as a field period $T_{Lr}$ indicating the light-emission period for the light emitter 311, the period of one-third, in the middle of one frame period Tf is set as a field period $T_{Lg}$ indicating the light-emission period for the light emitter 312, and the period in the last one-third of one frame period Tf is set as a field period $T_{Lb}$ indicating the light-emission period for the light emitter 313. The light-emission pulse present in each field period represents the light-emission periods Tr, Tg, Tb in one frame period Tf for each light emitter 311, 312, 313. The ON period of each light-emission drive signals Dr, Dg, Db, i.e., the light-emission periods Tr, Tg, Tb has a length not shorter than the fixed light-emission periods $T_{Fr}$, $T_{Fg}$, $T_{Fb}$. The fixed light-emission periods $T_{Fr}$, $T_{Fg}$, $T_{Fb}$ are set to be a minimum light-emission period within the range in which the effects of the disturbances, such as circuit noise are small enough not to cause practical problem, in detecting, by means of a light detector 36 to be described later, the light emission intensity of the light emitted from each light emitter 311, 312, 313, or a light-emission period a little longer than the minimum light-emission period considering some margin. The light-emission characteristics of the light emitters 311, 312, 313 may differ depending on the kind of the light emitters 311, 312, 313, so that it is so arranged that each fixed light-emission period $T_{Fr}$, $T_{Fg}$, $T_{Fb}$ can be set independently for each kind (color) of the light emitters 311, 312, 313. By setting each light-emission periods Tr, Tg, Tb of each light emitters 311, 312, 313, to be equal to or longer than each fixed light-emission period $T_{Fr}$, $T_{Fg}$, $T_{Fb}$, the light emission intensity detected by the light detector 36 will not become insufficient, and accurate detection of the light emission intensity is possible.

The light source 31 has a light emitter 311 for emitting red light, a light emitter 312 for emitting green light, and a light emitter 323 for emitting blue light. Light emitters 311, 312, 313 emit light in accordance with the respective light-emission drive signals Dr, Dg, Db output from the light source controller 35.

Semiconductor lasers or LEDs (Light Emitting Diodes) for emitting red light, green light, and blue light may be used as the light emitters 311, 312, 313. The three light emitters 311, 312, 313 are used for the respective basic colors, which are assumed to be used, as a prerequisite of generating the image data. The light source may however be of a different configuration as long as it can emit light of all the basic colors. For instance, two light emitters both emitting blue light (two light emitters emitting light beams of two blue colors, having tints different from each other) may be included.

The illuminating unit 32 includes a light guiding plate into which the light beams emitted from the light emitters 311, 312, 313 are incident, and a diffusing plate for diffusing the light emitted from the light guiding plate, and illuminating the image display unit 33 with the light emitted from the light emitters 311, 312, 313.

The image display unit 33 generates a display image by controlling the transmitting unit for transmitting the incident light, or a reflecting unit for reflecting the incident light, for each pixel, based on the display image signal VC output from the image signal analyzer 34. Each of the "transmitting unit" and the "reflecting unit" is a type of "modulating unit". An optical modulation device, such a transmission-type or reflection-type liquid crystal display panel may be used as the image display unit 33. In the following, a transmission-type optical modulation device is described as an example. The light detector 36 detects the time integral of the intensity of light emitted from each of the light emitters 311, 312, 313 in the fixed light-emission periods $T_{Fr}$, $T_{Fg}$, $T_{Fb}$, in synchronism with the light-detection period signals LDr, LDg, LDb output from the light source controller 35, and thereby determines the average light-emission peak values Ir1, Ig1, Ib1 which are averages of the peak value of the fixed light-emission periods $T_{Fr}$, $T_{Fg}$, $T_{Fb}$, for each light emitter, and outputs the average light-emission peak values Ir1, Ig1, Ib1 to the peak value corrector 37. If the periods for detecting the light by means of the light detector 36 do not overlap each other, between different light emitters, as shown in FIGS. 8(*a*) to 8(*c*), it is not necessary to provide a plurality of light-detection sensors for the respective light emitters. In such a case, a single sensor may be provided at a position where the light from the light emitters 311, 312, 313 can be detected, and yet the average light-emission peak values Ir1, Ig1, Ib1 for the respective light emitters can be detected.

The peak value corrector 37 determines peak value differences Ier, Ieg, Ieb obtained by subtracting the reference peak values tIr, tIg, tIb for each light emitter output from the reference peak value memory 38, from the average light-emission peak values Ir1, Ig1, Ib1 for the corresponding light emitter output from the light detector 36. The calculation of the difference value by the peak value corrector 37 is made for each color, and can be represented by the following equation.

$$Ier = Ir1 - tIr$$

$$Ieg = Ig1 - tIg$$

$$Ieb = Ib1 - tIb \quad (3)$$

The peak value corrector 37 converts the peak value differences Ier, Ieg, Ieb into peak value correction signals e_Ir, e_Ig, e_Ib representing the magnitude of the current driving the light emitter, and outputs the peak value correction signals e_Ir, e_Ig, e_Ib to the light source controller 35. The conversion can be performed by determining, in advance, the relationship between the light-emission drive signals for controlling the light emitter to emit light, and the light-emission peak values detected by the light detector 36, and by determining by calculation the peak value correction value (the value of the peak value correction signal).

Instead of calculating the peak value differences Ier, Ieg, Ieb and thereafter performing the conversion, as described above, a table in which peak value correction values corresponding to the differences between the reference light-emission value and the average light-emission peak value are stored may be formed in advance, and the peak value correction value may be read from the table.

Moreover, the peak value which can be used as a reference for the light-emission drive signals Dr, Dg, Db in the light source controller 3, in order to have each light emitter emit light with a predetermined light emission intensity, is stored in the reference peak value memory 38, as reference drive peak values sIR, sIG, sIB. For example, the peak values of the control signals (drive signals) input to the respective light emitters immediately after adjustment to emit light, whose peak value is the reference peak value, with proper color balance is performed, at the time of manufacturing of the image display apparatus, may be stored and used as the reference drive peak values.

Figure 9:
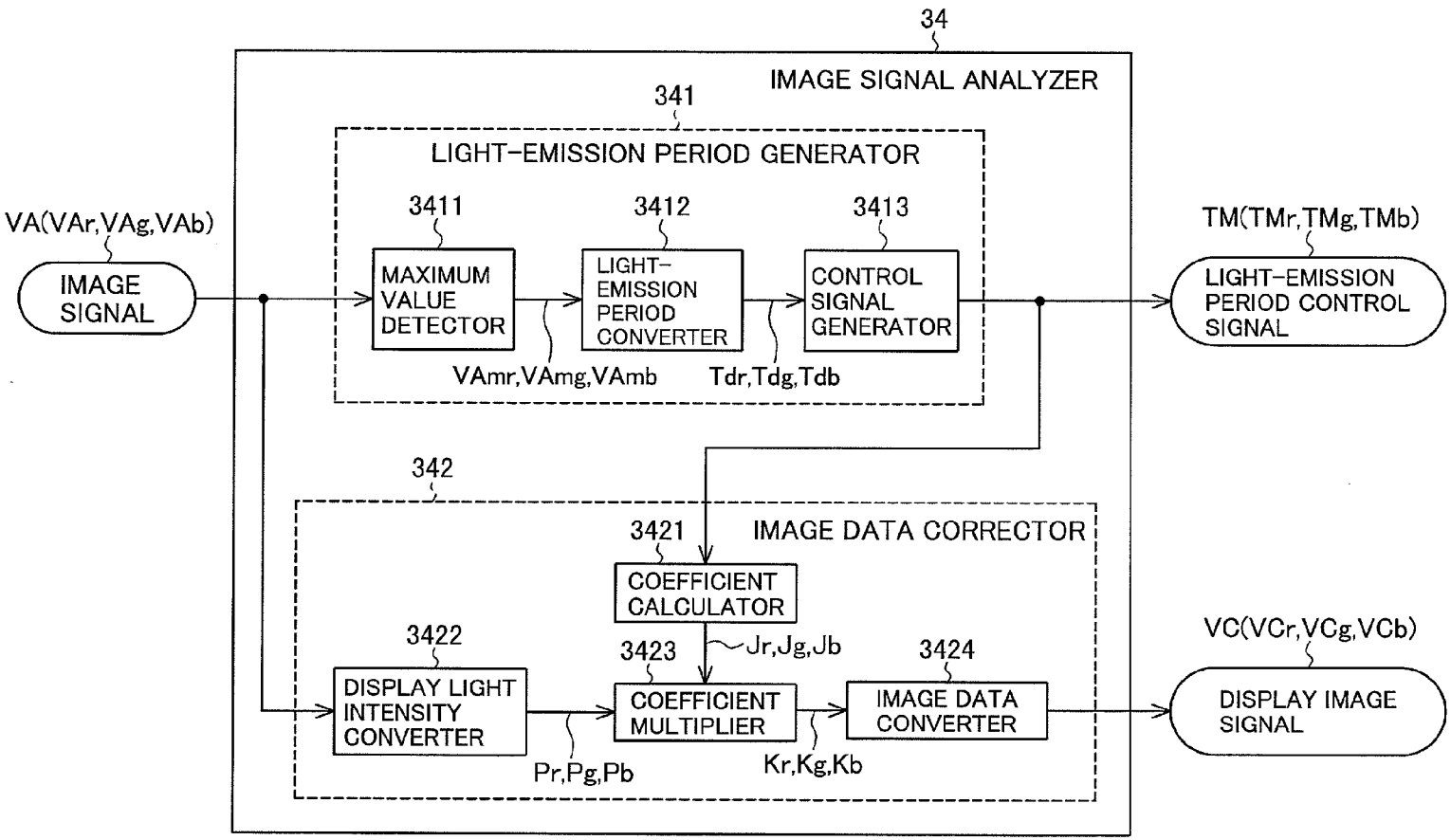
FIG. 9 is a block diagram showing an example of configuration of the image signal analyzer in the image display apparatus of Embodiment 4.

Next, the image signal analyzer 34 is described in detail. FIG. 9 is a block diagram showing the internal configuration of the image signal analyzer 34.

In FIG. 9, the image signal analyzer 34 includes a light-emission period generator 341 determining the light-emission period using the input image signal, and outputting light-emission period control signals TM (TMr, TMg, TMb) representing the light-emission period, and an image data corrector 342 using the light-emission period control signals TM (TMr, TMg, TMb) to correct the input image signal VA, for output as display image signals VC (VCr, VCg, VCb). The light-emission period control signals TM (TMr, TMg, TMb) generated by the light-emission period generator 341 are output to the light source controller 35, and the display image signals VC (VCr, VCg, VCb) generated by the image data corrector 342 are output to the image display unit 33.

Each block shown in FIG. 9 carries out separate processing for the signals or data of three colors, and may have three units having identical configuration and processing the signals or data of the respective colors. This is also true for the blocks shown in FIG. 10 and FIG. 13 described later.

The light-emission period generator 341 includes a maximum value detector 3411, a light-emission period converter 3412, and a control signal generator 3413.

As will be described below, the light-emission period generator 341 detects the maximum value of each color image data in each frame, and then sets a suitable light-emission period for each light emitter, such that a display light amount (time integral of the display light intensity over each frame period) corresponding to the maximum value of the image data can be obtained for displaying an image, when the image display unit 33 transmits the incident light at a transmittance not larger than 1. In other words, if one of the light-emission periods is longer than corresponding one of the fixed light-emission periods $T_{Fr}$, $T_{Fg}$, $T_{Fb}$, and the transmittance is 1, the display light amount corresponds to the maximum value of the image data.

The maximum value detector 3411 detects the maximum values VAmr, VAmg, VAmb of the data values of the respective pixels in the frame, from each color image data included in the image signal of the frame in question, and outputs the detected maximum value to the light-emission period converter 3412. The "maximum value" need not be a maximum value in the strict sense, it may be the Nth (e.g., tenth) largest value, or the average value of the N largest values, where N is a predetermined positive integer. Such a value may be called "a value treated as the maximum value", but may also be referred to simply as a "maximum value".

The light-emission period converter 3412 converts the maximum value of each color image data into light-emission periods (calculated value of light-emission period or first light-emission period) Tdr, Tdg, Tdb. Each of the light-emission periods (first light-emission period) Tdr, Tdg, Tdb obtained by the conversion is a light-emission period for each color necessary for producing a light amount (time integral of the display light intensity) corresponding to the maximum value of each color image data when the transmittance at the image display unit 33 is 1 (i.e., the light-emission period resulting in the display light amount corresponding to the maximum value of each color image data when the transmittance is 1). This conversion is performed by storing, in advance, the light-emission periods corresponding to the values of each color image data in a lookup table, and by reading the stored light-emission period. The light-emission period converter 3412 outputs the first light-emission periods Tdr, Tdg, Tdb of each color thus obtained, to the control signal generator 3413.

The control signal generator 3413 stores, internally, predetermined fixed light-emission periods $T_{Fr}$, $T_{Fg}$, $T_{Fb}$, and compares each first light-emission period Tdr, Tdg, Tdb for each color image data, with each fixed light-emission period $T_{Fr}$, $T_{Fg}$, $T_{Fb}$, and uses each first light-emission period Tdr, Tdg, Tdb, as a set value of the light-emission period, i.e., as each second light-emission period Tr, Tg, Tb, with regard to the color image data with which each first light-emission period Tdr, Tdg, Tdb is equal to or longer than each fixed light-emission period $T_{Fr}$, $T_{Fg}$, $T_{Fb}$, and outputs each signal representing the set value Tr, Tg, Tb of the light-emission period as each light-emission period control signal TMr, TMg, TMb.

With regard to the color image data for which one of the first light-emission periods Tdr, Tdg, Tdb is shorter than corresponding one of the fixed light-emission periods $T_{Fr}$, $T_{Fg}$, $T_{Fb}$, one of the fixed light-emission periods $T_{Fr}$, $T_{Fg}$, $T_{Fb}$ is used as corresponding one of the set value Tr, Tg, Tb of the light-emission period, and a signal representing one of the light-emission periods Tr, Tg, Tb is output as corresponding one of the light-emission period control signals TMr, TMg, TMb. In this way, when one of the first light-emission periods Tdr, Tdg, Tdb obtained by calculation by the light-emission period converter 3412 is less than corresponding one of the predetermined fixed light-emission periods $T_{Fr}$, $T_{Fg}$, $T_{Fb}$, the corresponding one of the fixed light-emission periods $T_{Fr}$, $T_{Fg}$, $T_{Fb}$ is used, in place of the calculated first light-emission period, as the corresponding one of the light-emission periods Tr, Tg, Tb. That is, the fixed light-emission periods $T_{Fr}$, $T_{Fg}$, $T_{Fb}$ are minimum durations for the light-emission periods Tr, Tg, Tb.

The set values Tr, Tg, Tb of light-emission period are used to determine the light-emission period for the light emitter, so that they may also be referred to simply as "light-emission period".

The image data corrector 342 includes a coefficient calculator 3421, a display light intensity converter 3422, a coefficient multiplier 3423, and an image data converter 3424.

The light-emission period control signals TMr, TMg, TMb are input to the coefficient calculator 3421. Based on the light-emission periods Tr, Tg, Tb of each color represented by the light-emission period control signals TMR, TMg, TMb, multiplication coefficients Jr, Jg, Jb for each color image data are calculated. The multiplication coefficients Jr, Jg, Jb are used to display with a light amount indicated by the color image data, even when the light-emission period is changed. The details will be described later, but when the light-emission period is short, the multiplication coefficients Jr, Jg, Jb become large, while when the light-emission period is long, the multiplication coefficients become small. The calculation may be performed by storing, in advance, the multiplication coefficients Jr, Jg, Jb corresponding to the light-emission periods for each color in a lookup table, and by reading the stored coefficient.

The display light intensity converter 3422 converts each color image data, i.e., pixel values VAr, VAg, VAb of each pixel, included in the image signal, into display light intensity Pr, Pg, Pb. The conversion is performed by storing, in advance, the display light intensities corresponding to the values of each color image data in a lookup table, and by reading the stored display light intensity. The display light intensity converter 3422 outputs each display light intensity Pr, Pg, Pb thus obtained, to the coefficient multiplier 3423.

The coefficient multiplier 3423 multiplies each display light intensity by the corresponding multiplication coefficient Jr, Jg, Jb, to obtain each transmittance Kr, Kg, Kb. This transmittance is the transmittance for each color image data that is needed to produce the display light intensity when the light-emission period is set equal to corresponding one of the light-emission period control signals Tr, Tg, Tb. The transmittance Kr, Kg, Kb for each color image data is output to the image data converter 3424.

The image data converter 3424 converts each transmittance Kr, Kg, Kb into each display image data VCr, VCg, VCb. The conversion is performed by storing, in advance, the display image data VCr, VCg, VCb corresponding to the transparencies Kr, Kg, Kb in a lookup table, and by reading the display image data. The display image signal VC consisting of display image data VCr, VCg, VCb obtained by the conversion, is output to the image display unit 33.

Figure 10:
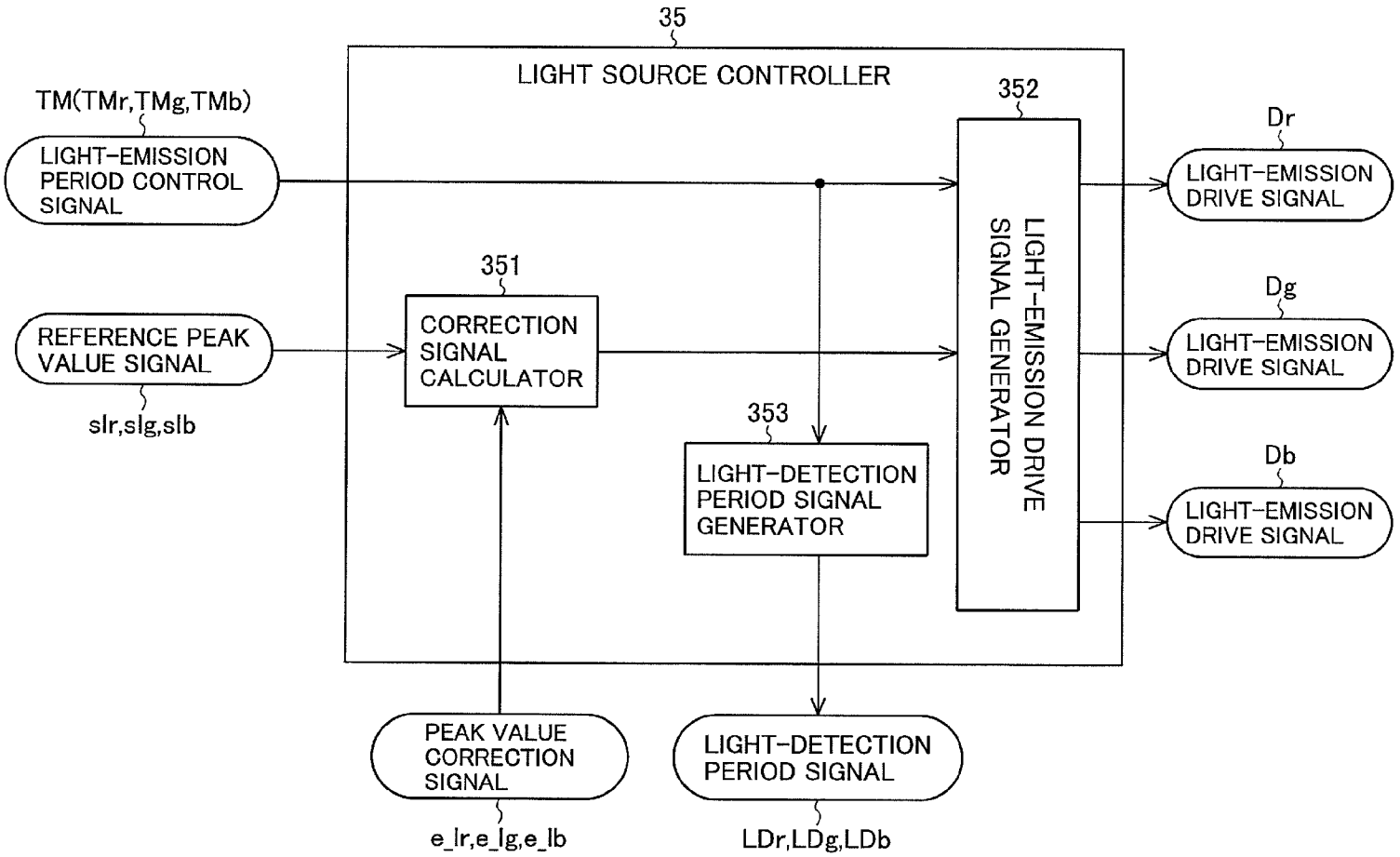
FIG. 10 is a block diagram showing an example of configuration of the light source controller in the image display apparatus of Embodiment 4.
Figure 11A:
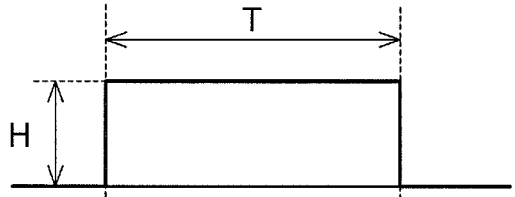
FIGS. 11(*a*) to 11(*e*) are waveform diagrams showing the relationship between the light amount of the illumination light emitted from the light emitter, and the light amount of the illumination light utilized for the image display.
Figure 11B:
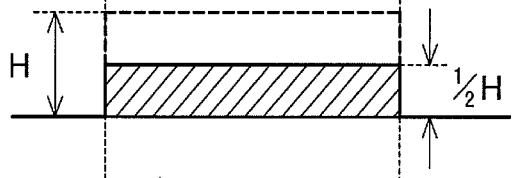
Figure 11C:
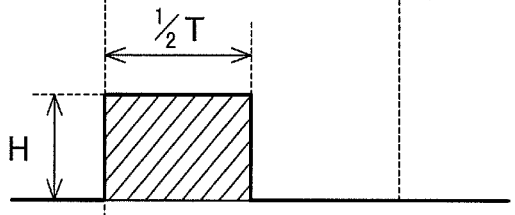
Figure 11D:
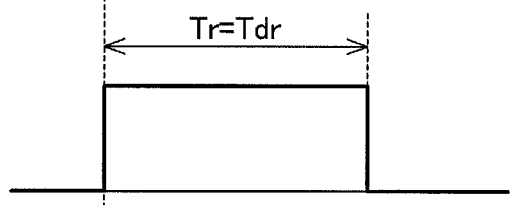
Figure 11E:
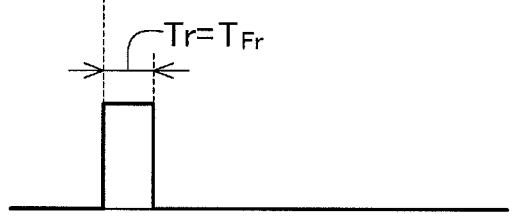

Next, the light source controller 35 is described in detail. FIG. 10 is a block diagram showing the internal configuration of the light source controller 35. In FIG. 10, the light source controller 35 includes a correction signal calculator 351, a light-emission drive signal generator 352, and a light-detection period signal generator 353.

The correction signal calculator 351 stores, internally, each peak value of each light emission drive signal Dr, Dg, Db for the preceding frame, as each drive peak value o_Ir, o_Ig, o_Ib, and subtracts each peak value correction signal e_Ir, e_Ig, e_Ib, which is input from each peak value corrector 37, from the drive peak value o_Ir, o_Ig, o_Ib, to determine peak value of each light-emission drive signal Dr, Dg, Db to be input to each light emitter, such that each light emitter emits light with a desired light emission intensity.

When generating the light-emission drive signals Dr, Dg, Db initially, e.g., when the power supply to the image display apparatus is turned on, the correction signal calculator 351 uses each reference drive peak value sIr, sIg, sIb for each light emitter input from the reference peak value memory 38, in place of each drive peak value o_Ir, o_Ig, o_Ib for the preceding frame. By the subtraction described above, when each peak value correction signal e_Ir, e_Ig, e_Ib is positive, each peak value of each light-emission drive signal Dr, Dg, Db becomes smaller, and when each peak value correction signal e_Ir, e_Ig, e_Ib is negative, each peak value of each light-emission drive signal Dr, Dg, Db becomes larger.

By the processing described above, if one of the average light-emission peak values Ir1, Ig1, Ib1 detected by the light detector 36 is larger than corresponding one of the reference peak values tIr, tIg, tIb, the peak value of corresponding one of the light-emission drive signals Dr, Dg, Db is corrected to be a lower value, while if one of, the average light-emission peak values Ir1, Ig1, Ib1 is smaller than corresponding one of the reference peak values tIr, tIg, tIb, the peak value is corrected to be a higher value.

The peak value changed to a lower value or a higher value, is maintained to be of the same value, as long corresponding one of the peak value correction signals e_Ir, e_Ig, e_Ib are thereafter zero.

In addition, the calculation for determining the peak value of the light-emission drive signal at the correction signal calculator 351 is made also for each color.

The light-emission drive signal generator 352 generates, for each light emitter, each light-emission drive signal Dr, Dg, Db with which the peak value during each light-emission period Tr, Tg, Tb for each light emitter represented by each light-emission period control signal TMr, TMg, TMb is equal to the peak value of each light emitter calculated by the correction signal calculator 351. The generated light-emission drive signals Dr, Dg, Db are output from the light-emission drive signal generator 352 to the corresponding light emitter.

The light-detection period signal generator 353 stores, internally, information representing the lengths of the above-mentioned fixed light-emission periods $T_{Fr}$, $T_{Fg}$, $T_{Fb}$, and uses the input light-emission period control signals TMr, TMg, TMb to generate each light-detection period signal LDr, LDg, LDb which is in synchronism with each light-emission drive signal Dr, Dg, Db (i.e., with the anterior edges being coincident), and which has the length of each fixed light-emission period $T_{Fr}$, $T_{Fg}$, $T_{Fb}$. The generated light-detection period signals LDr, LDg, LDb are output to the light detector 36.

Next, setting of the coefficient Jr, Jg, Jb in the coefficient calculator 3421 in the image data corrector 342 in FIG. 9 is described. In the following description, the light emitter 311 is taken as an example, but similar description is applicable to the other light emitters 312, 313.

FIGS. 11(*a*) to 11(*e*) are waveform diagrams showing the relationship between the light emission intensity of the illumination light emitted from the light emitter 311, the light-emission period, the transmittance, and the light amount (display light amount) of the illumination light utilized for displaying an image. FIG. 11(*a*) show the light amount that is obtained when the light emitter 311, controlled with the light source control signal Dr having a predetermined peak value (H), emits light for a predetermined light-emission period (T), FIG. 11(*b*) shows the case where the transmittance is reduced to half compared with FIG. 11(*a*), and FIG. 11(*c*) shows the case where the light-emission period is reduced to half compared with FIG. 11(*a*).

The light amount (L) of the image display light output from the image display unit 33 (the product of the intensity of display light and the light-emission time, or, in a more general term, the time integral of the display light intensity) can be described by the following equation (4) using the peak value (H) of the light-emission drive signal Dr and the light-emission period (T) of the light emitter 311, and the transmittance (K) of the image display unit 33. For simplicity, it is assumed that the light emitter 311 emits light of an intensity having the same value as the peak value (H) of the input light-emission drive signal Dr, and the light is not attenuated at the illuminating unit 32.

$$L=H\times T\times K \text{ (where, } 0\leq K\leq 1) \tag{4}$$

For instance, if the light-emission period (T) of the light emitter 311 and the peak value (H) are constant, tone of an image to be displayed can be expressed by changing the transmittance (K). When the transmittance is maximum (K=1), L=HT as shown in FIG. 11(*a*), the entirety of the illumination light from the light emitter 311 incident on the image display unit 33 is utilized for displaying an image, and the image is displayed with the maximum light amount.

When K=0.5, the light amount (L) output from the image display unit 33 is as shown in FIG. 11(*b*), and given by the equation (5).

$$L=H\times T\times 0.5 \tag{5}$$

In this case, half of the illumination light from the light emitter 311 incident on the image display unit 33 is utilized for displaying an image, and the remaining half of the illumination light is not utilized for displaying an image. That is, half of the light amount (H×T) of the illumination light emitted from the light source 31 is transmitted, and the image is displayed using the light amount transmitted. This may be considered schematically that the illumination light shown by the hatched part in FIG. 11(*b*) is utilized for displaying an image. The remaining, unhatched part represents the unnecessary light amount which is not utilized for displaying an image. The illumination light which is not utilized for displaying an image causes stray light and decrease in contrast. It is therefore desirable that the light source is made to emit light in an amount required for displaying an image.

One method for eliminating the unnecessary light amount and obtaining the image display light of the same amount as that expressed by the equation (5), is to reduce the light-emission period to half, while maintaining the transmittance at 1, as shown in FIG. 11(*c*). When the light amount (L) in this case is calculated by the equation (4), the light-emission period is set at T2=0.5T, and the transmittance is maximum (K=1), so that, $$L=H\times T2\times 1=H\times(0.5T)=0.5HT \tag{6}$$

Thus, it is possible to obtain the image display light of the same amount as when K=0.5 and the light-emission period=T.

Accordingly, the light-emission period is determined based on the maximum value VAmr of the image data in each frame, in the manner described above. That is, the light-emission period which results in the display light amount (Lm) corresponding to the maximum value VAmr of the image data when the transmittance is 1, is determined as the light-emission period calculated value Tdr. If the light-emission period calculated value Tdr is not less than the fixed light-emission period ($T_{Fr}$), the light-emission period calculated value Tdr is used as the light-emission period set value Tr (FIG. 11(*d*)), while if the light-emission period calculated value Tdr is less than the fixed light-emission period $T_{Fr}$, the fixed light-emission period $T_{Fr}$ is used as the light-emission period set value Tr (FIG. 11(*e*)).

And, for each pixel, the coefficient calculator 3421 determines the multiplication coefficient Jr, which is a coefficient for producing a transmittance Kr(x,y) required for outputting the display light intensity Pr(x,y) for each pixel, when the light-emission period is equal to the light-emission period set value Tr. That is, the multiplication coefficient Jr is determined by:

$$Jr=\alpha/Tr \tag{7A}$$

Here, $\alpha$ represents a constant based on the reference drive peak value.

By multiplying the display light intensity Pr(x,y) by the multiplication coefficient Jr, the transmittance Kr(x,y) based on the light-emission period set value Tr can be obtained.

$$Kr(x,y)=Pr(x,y)\times Jr \tag{7B}$$

To the extent the light-emission period set value Tr is shortened, the transmittance Kr is set to be larger.

In this way, by shortening the light-emission period to eliminate the unnecessary light emission, and increasing the transmittance of the liquid crystal display panel to compensate for the reduction in the light-emission period, it is possible to utilize the amount of light emitted by the light source, without waste. Specifically, to the extent the light-emission period is shortened, the multiplication coefficient Jr set by the coefficient calculator 3421 is enlarged so that the coefficient Jr used for multiplication with the image signal at the coefficient multiplier 3423 in the image data corrector 342 is enlarged, so that the value indicating the display light intensity, output from the coefficient multiplier 3423 is enlarged, and the transmittance at the image display unit 33 is thereby increased.

As has been described, the light-emission period is changed in accordance with the magnitude of the input image data, so as not to be shorter than the fixed light-emission periods $T_{Fr}$, $T_{Fg}$, $T_{Fb}$. Because it is possible to make the light source to emit light in an amount necessary for displaying an image, eliminating unnecessary light-emission, the decrease in contrast due to the stray light can be reduced.

In the image display apparatus of the present embodiment, the light amount of each illumination light emitted from each light emitter 311, 312, 313 is detected by the light detector 36, and the peak value of each light-emission drive signal Dr, Dg, Db is corrected, such that the average values of the peak values indicating the magnitude of the detected light amounts are equal to the respective reference peak values tIr, tIg, tIb output from the reference peak value memory 38. Accordingly, it is possible to prevent the color change or coloring in image display, due to the change in the color balance of the illumination light, due to the change in the peak value depending on the light-emission period, or the characteristics of the individual light emitter, even if the peak values of the light-emission drive signals Dr, Dg, Db are constant, in a situation where the semiconductor lasers and LEDs are made to emit light at a constant period.

Moreover, the light-emission period converter 3412 calculates the light-emission period for each light emitter required to output a light amount corresponding to the maximum value of each color image data when the transmittance of the image display unit 33 is a predetermined value not larger than 1, and each light emitter is controlled to emit light based on the calculated light-emission period. That is, the light-emission period for each light emitter is so controlled that light is not emitted in a period which is not required for displaying an image according to the input image data, so that when the input image is bright (the maximum value of the image signal is large), the light-emission period for the light emitter is long, while when the image is dark (the maximum value of the image signal is small), the light-emission period is short. By providing a turn-off period in which each light emitter does not emit light, depending on the image, the stray light and the decrease in contrast can be reduced, compared with the case, where the light is kept emitting.

Even when the light-emission period becomes short, each light emitter is made to emit light for a light-emission period which is not shorter than each fixed light-emission period $T_{Fr}$, $T_{Fg}$, $T_{Fb}$, and the light amount is detected in each fixed light-emission period $T_{Fr}$, $T_{Fg}$, $T_{Fb}$, so that the light amount can be detected and controlled accurately, with the result that even when the light-emission period is changed, the color balance of the image can be adjusted to be constant. As a result, an image of a stable, high-image quality can be displayed.

In the above description, the light detector 36 is a single sensor positioned to detect the light beams from the light emitters 311, 312, 313. However, sensors may be provided for respective light emitters, and the light amount may be detected by each sensor.

Embodiment 5

Figure 12:
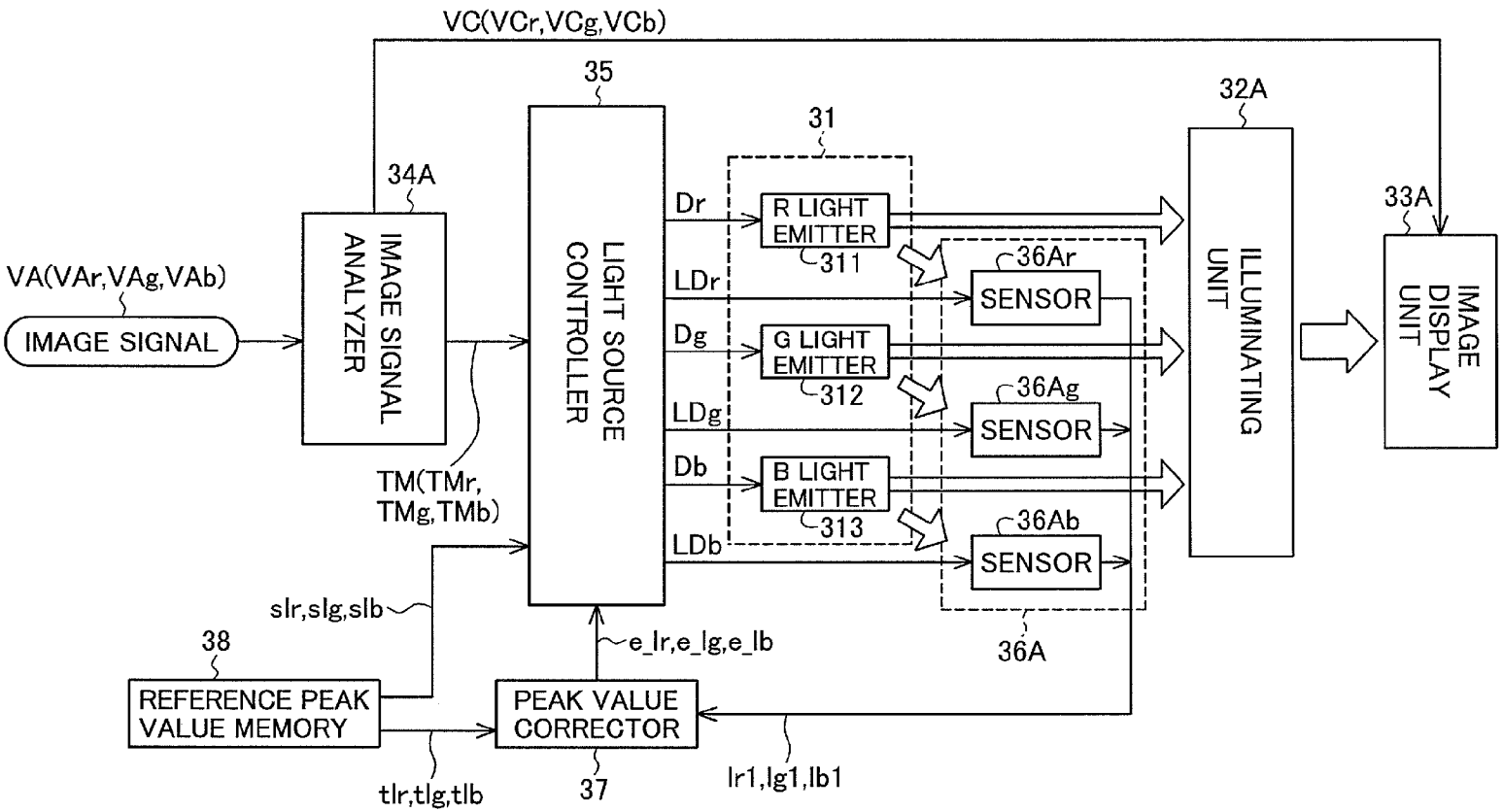
FIG. 12 is a block diagram showing the configuration of the image display apparatus of Embodiment 5.

FIG. 12 is a block diagram showing the configuration of the image display apparatus of Embodiment 5 of the present invention.

In the image display apparatus of Embodiment 4, one third period of one frame is allotted to the light-emission period for each light emitter, and the light is emitted in a time-division fashion, i.e., in such a manner that the light-emission periods for the light emitters of a plurality of colors do not overlap each other. In the image display apparatus of Embodiment 5, the light-emission period for each light emitter is determined within one frame period. The image display apparatus of the present Embodiment 5 includes an image signal analyzer 34A, a light source controller 35, a light source 31 having light emitters 311, 312, 313, an illuminating unit 32A, an image display unit 33A, a light detector 36A, a peak value corrector 37, and a reference peak value memory 38. Reference numerals identical to those in Embodiment 4 shown in FIG. 7 denote members of identical configuration, and their description is omitted.

Figure 13:
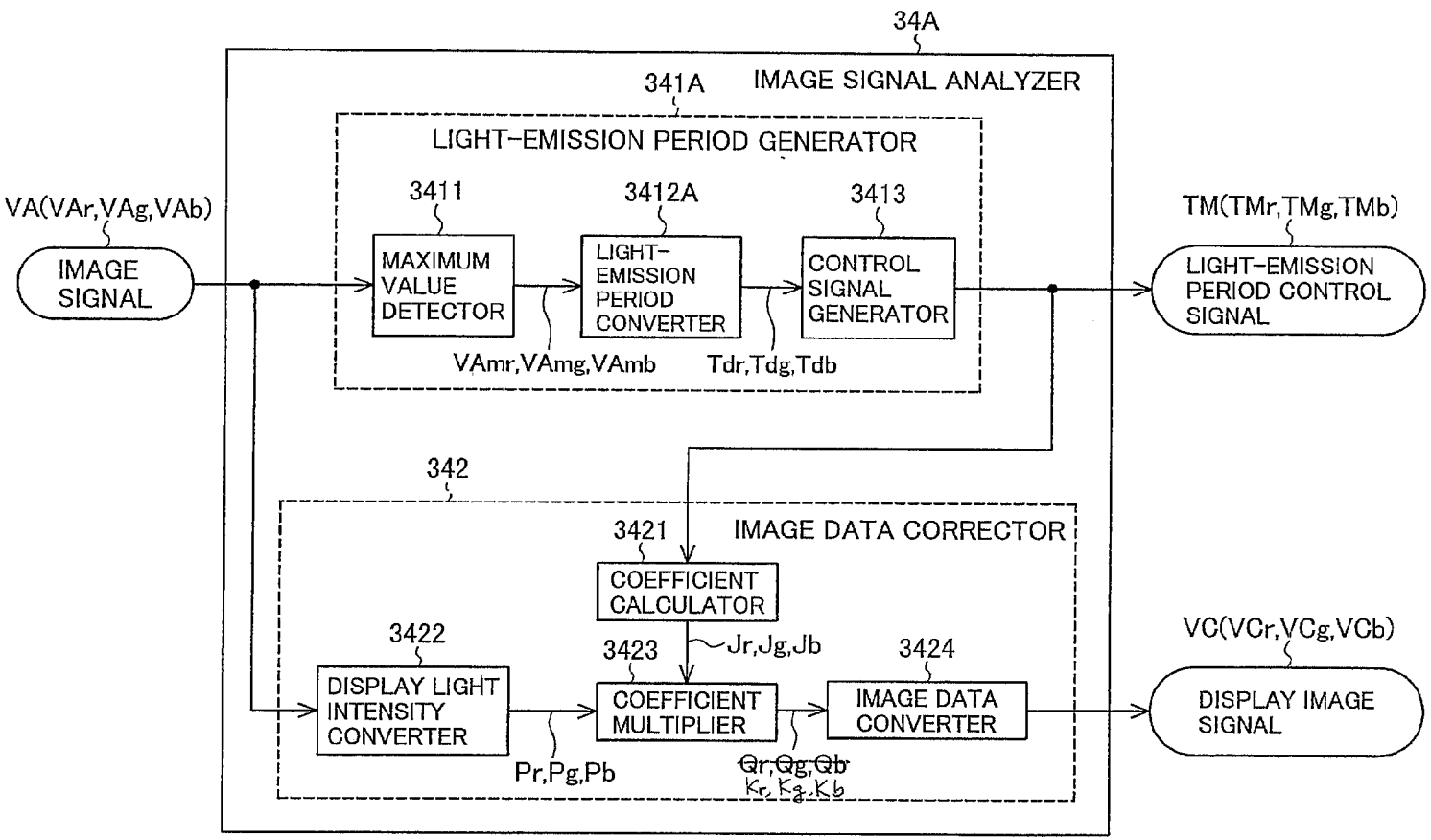
FIG. 13 is a block diagram showing an example of configuration of the image signal analyzer in the image display apparatus in Embodiment 5.

FIG. 13 is a block diagram showing the internal configuration of the image signal analyzer 34A of Embodiment 5. In FIG. 13, the image signal analyzer 34A includes a light-emission period generator 341A and an image data corrector 342. In FIG. 13, members identical to or corresponding to those in FIG. 9 are designated by identical reference marks, and their description is omitted.

The light-emission period converter 3412A converts the maximum value VAmr, VAmg, VAmb of each color image data output from the maximum value detector 3411, respectively into the light-emission periods Tdr, Tdg, Tdb. The light-emission period is a light-emission period for each color, required to output a light amount corresponding to the maximum value of each color image data when the transmittance of the image display unit 33 is 1. The conversion is performed by storing, in advance, the light-emission periods corresponding to the values of each color image data, and by reading the stored light-emission period. In the light-emission period converter 3412 in Embodiment 4, the light-emission periods corresponding to the image data within one-third of the frame period are stored for each light emitter, whereas in the light-emission period converter 3412A of the present embodiment, the light-emission periods corresponding to the image data within one frame period are stored for each light emitter. That is, the maximum value of the light-emission period stored in the light-emission period converter 3412A is the one frame period for each light emitter.

By operations similar to those in Embodiment 4, and using the light-emission periods Tdr, Tdg, Tdb obtained by conversion at the light-emission period converter 3412A, the light-emission periods are determined, and the light-emission period control signals TMr, TMg, TMb are generated, and at the same time respective image data are corrected based on the light-emission period control signals TMr, TMg, TMb, to produce the display image signal VC (VCr, VCg, VCb).

Figures 14A, 14B, 14C:
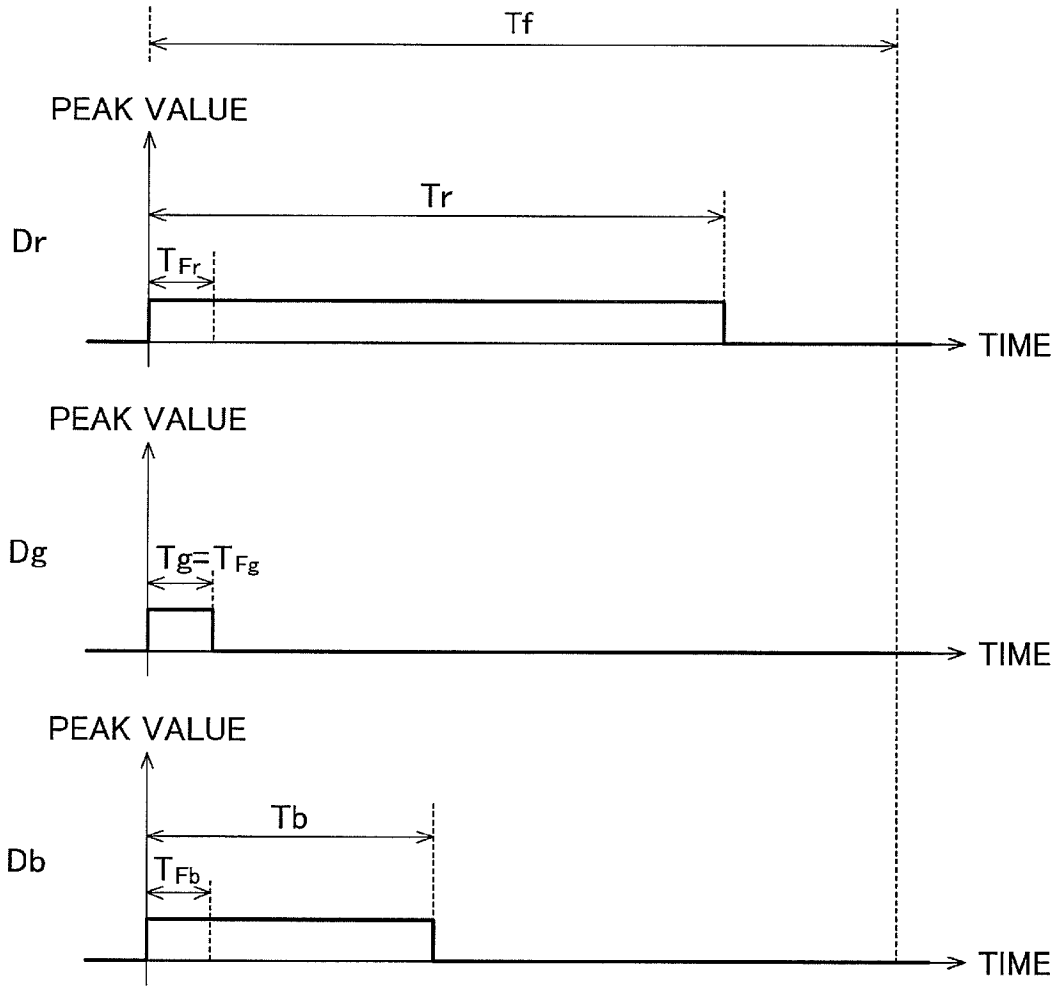
FIGS. 14(*a*) to 14(*c*) are waveform diagrams showing examples of light-emission drive signals Dr, Dg, Db within one frame period in the image display apparatus of Embodiment 5.

FIGS. 14(*a*) to 14(*c*) are waveform diagrams showing an example of the light-emission drive signals Dr, Dg, Db output by the light source controller 35, based on the light-emission period control signals TMr, TMg, TMb output from the image signal analyzer 34A. In FIGS. 14(*a*) to 14(*c*), parts identical to or corresponding to those in FIGS. 8(*a*) to 8(*c*) are denoted by identical reference marks, and their description is omitted. In FIGS. 14(*a*) to 14(*c*), each light-emission period Tr, Tg, Tb for each light emitter is controlled within the range of one frame period Tf, and the light-emission period for each light emitter is changed according to the input image data. The ON period of each light-emission drive signal Dr, Dg, Db, i.e., each light-emission period Tr, Tg, Tb is set within the range of one frame period, without inhibiting mutual overlap. In the illustrated example, the starting points of the ON periods of the light-emission drive signals Dr, Dg, Db are the same. Like Embodiment 4, the light-emission periods Tr, Tg, Tb are set to have a time length which is not shorter than the fixed light-emission periods $T_{Fr}$, $T_{Fg}$, $T_{Fb}$ which is the minimum light-emission period. The fixed light-emission periods $T_{Fr}$, $T_{Fg}$, $T_{Fb}$ in the present embodiment are identical to those in Embodiment 4.

As has been described, when the light emitters emit light simultaneously, the fixed light-emission periods $T_{Fr}$, $T_{Fg}$, $T_{Fb}$ which are the minimum light-emission periods for the respective light emitters appear simultaneously as shown in FIGS. 14(*a*) to 14(*c*). Accordingly, the light detector 36A is provided with sensors for the respective light emitters, at positions for detecting the light beams from the light emitters 311, 312, 313, and the light amounts are detected by the respective sensors 36Ar, 36Ag, 36Ab.

The light detector 36A determines the average light-emission peak values Ir1, Ig1, Ib1 of the light beams emitted by the light emitters 311, 312, 313 in the fixed light-emission periods $T_{Fr}$, $T_{Fg}$, $T_{Fb}$, based on the light-detection period signals LDr, LDg, LDb in synchronism with the fixed light-emission periods $T_{Fr}$, $T_{Fg}$, $T_{Fb}$ output from the light source controller 35, and outputs the average light emission peak values to the peak value corrector 37.

Using the average light-emission peak value Ir1, Ig1, Ib1 for each light emitter, output from the light detector 36A (sensor 36Ar, 36Ag, 36Ab), and the reference peak values tIr, tIg, tIb for each light emitter output from the reference peak value memory 38, the peak value corrector 37 operates in a manner similar to that in Embodiment 4, and outputs the peak value correction signals e_Ir, e_Ig, e_Ib to the light source controller 35. The peak values which are used as references are stored in the reference peak value memory 38, as the reference drive peak values sIr, sIg, sIb, and the light source controller 35 generates the light-emission drive signals Dr, Dg, Db for each light emitter, using the drive peak values o_Ir, o_Ig, o_Ib of the preceding frame, the peak value correction signals e_Ir, e_Ig, e_Ib, and the light-emission period control signals TMr, TMg, TMb, and also generates the light-detection period signals LDr, LDg, LDb indicating the fixed light-emission periods $T_{Fr}$, $T_{Fg}$, $T_{Fb}$ for each light emitter.

The illuminating unit 32A includes a light guiding plate on which the light emitted from each light emitter is incident, and a diffusing plate for diffusing the light emitted from the light guiding plate. The illuminating unit 32A makes the intensity of light emitted from each light emitter 311, 312, 313 uniform, and illuminates the image display unit 33A.

The image display unit 33A displays an image by modulating the intensity of illumination light from the light source, by varying the transmittance or the reflectivity for each color corresponding to the corresponding pixel, based on the display image data output from the image signal analyzer 34A. The image display unit 33A may, for example, be a color liquid crystal panel, in which each pixel has sub-pixels, each of the sub-pixels has a color filter which transmits only the corresponding color corresponding to each light emitter, and the transmittance for each color is controlled independently. The above is the operation of the image display apparatus of the present embodiment. The image display apparatus of the present embodiment can obtain effects similar to those of Embodiment 4.

Embodiment 6

Figure 15:
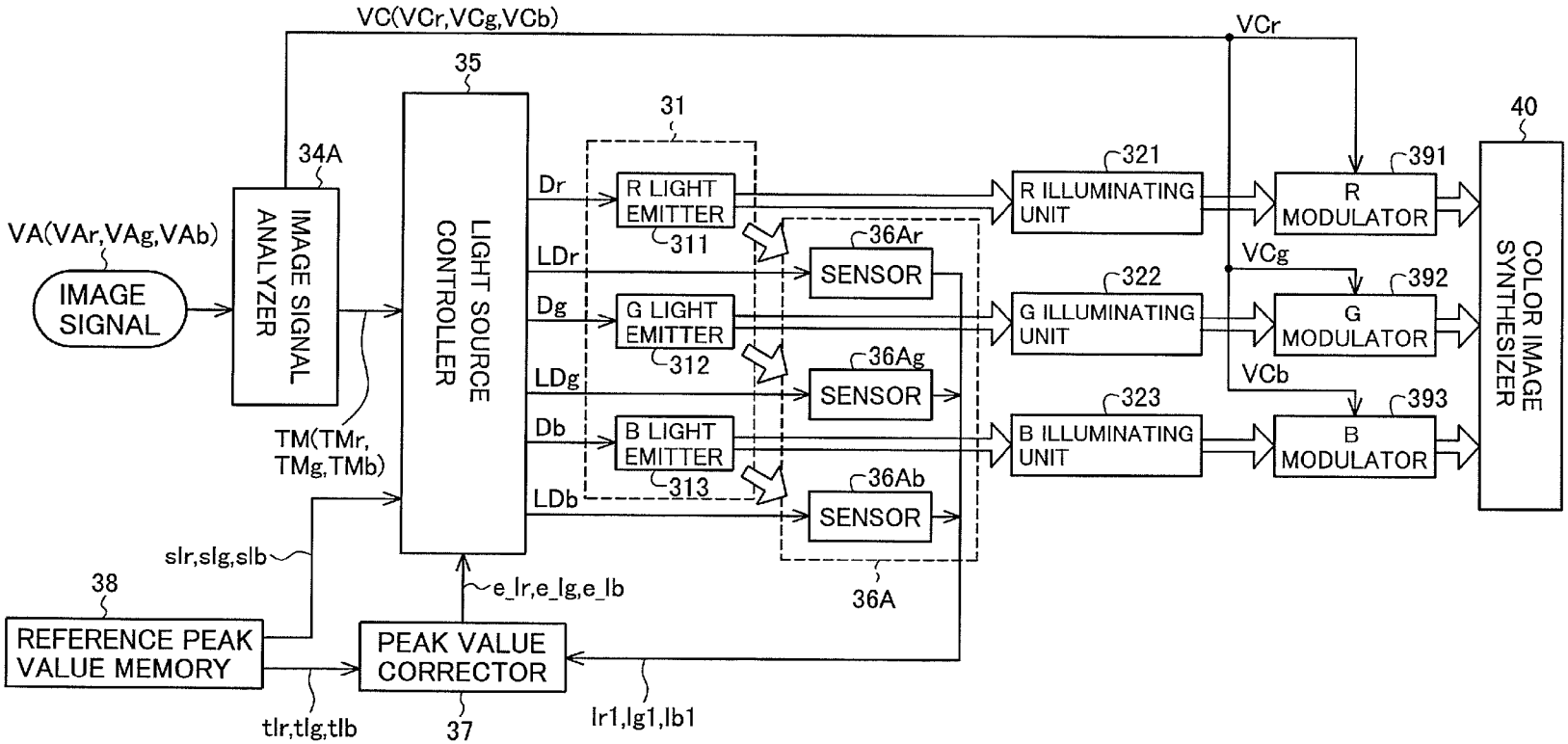
FIG. 15 is a block diagram showing the configuration of the image display apparatus of Embodiment 6.

FIG. 15 is a block diagram showing the configuration of the image display apparatus of Embodiment 6 of the present invention.

In the image display apparatus of Embodiment 6, optical modulation units are provided for the respective light emitters 311, 312, 313. The image display apparatus of Embodiment 6 includes an image signal analyzer 34A, a light source controller 35, a light source 31 having light emitters 311, 312, 313, an R illuminating unit 321, a G illuminating unit 322, a B illuminating unit 323, an R modulator 391, a G modulator 392, a B modulator 393, a color image synthesizer 40, a light detector 36A, a peak value corrector 37, and a reference peak value memory 38. The same reference numerals as those of Embodiment 5 shown in FIG. 12 denote the same structure, and their detailed description is omitted.

The image signal analyzer 34A determines the light-emission period for each light emitter, based on the image data, and generates the light-emission period control signals TMr, TMg, TMb, and corrects each image data, based on the light-emission period control signals TMr, TMg, TMb, to generate display image signal VC. Based on each light-emission period control signal TMr, TMg, TMb, each drive peak value o_Ir, o_Ig, o_Ib, and each peak value correction signal e_Ir, e_Ig, e_Ib, the light source controller 35 generates each light-emission drive signal Dr, Dg, Db for each light emitter, and generates the light-detection period signal LDr, LDg, LDb indicating each fixed light-emission period $T_{Fr}$, $T_{Fg}$, $T_{Fb}$ for each light emitter. Each light emitter emits light based on each light-emission drive signal Dr, Dg, Db, and the light detector 36A determines each average light-emission peak value Ir1, Ig1, Ib1 of the light emitted by each light emitter in each fixed light-emission period $T_{Fr}$, $T_{Fg}$, $T_{Fb}$, based on each light-detection period signal LDr, LDg, LDb. Using each average light-emission peak value Ir1, Ig1, Ib1 for each light emitter output from the light detector 36A, and each reference peak value tIr, tIg, tIb which is a peak value which will become the control target, and stored in the reference peak value memory 38, the peak value corrector 37 outputs each peak value correction signal e_Ir, e_Ig, e_Ib for each light emitter, to the light source controller 35. The above operation is similar to that of Embodiment 5.

The light beams from the R light emitter 311, the G light emitter 312, and the B light emitter 313 are respectively guided to the R modulator 391, the G modulator 392, and the B modulator 393, via the R illuminating unit 321, the G illuminating unit 322, and the B illuminating unit 323.

The display image signals VC for the respective colors generated by the image signal analyzer 34A are input to the modulators 391, 392, 393. The modulators 391, 392, 393 change the transmittance or reflectivity for each pixel corresponding to the display image signals VC, thereby to modulate the light beams emitted from the respective light emitters, and supplied via the respective illuminating units. Each of the modulators may be identical to that in Embodiment 4. The color image synthesizer 40 synthesizes the light beams modulated by the modulators 391, 392, 393, to generate a color image.

In the present embodiment, the modulators 391 to 391, and the color image synthesizer 40 form an image display unit.

The above is the operation of the image display apparatus of the present embodiment. In the image display apparatus of the present embodiment, the light-emission period for each light source is determined within one frame period, and the light beams emitted from the respective light sources are synthesized, after being passed through the corresponding optical modulation units 391, 392, 392. As a result, it is possible to realize an image brighter than in Embodiments 1 to 5.

In Embodiment 4, the peak value correction signal generated based on the difference between the average light-emission peak value and the reference peak value, is added to or subtracted from corresponding one of the drive peak values o_Ir, o_Ig, o_Ib, which are the peak values for the preceding frame, to determine the peak value of the light-emission drive signal. As an alternative, the correction value based on a ratio between the average light-emission peak value and the reference peak value may be added to or subtracted from the peak value of the light-emission drive signal having been used, to determine a new peak value of the light-emission drive signal, in the same manner described in Embodiment 1.

These are also applied to Embodiments 5 and 6.

EXPLANATION OF REFERENCE CHARACTERS

1 light source; 2 illuminating unit; 3 image display unit; 4 image signal analyzer; 5 light source controller; 6 light detector; 7 peak value corrector; 8 reference peak value memory; 10*r* light-emission period for R light emitter; 10*g* light-emission period for G light emitter; 10*b* light-emission period for B light emitter; 11*r*, 21*r* fixed light-emission period for R light emitter; 11*g*, 21*g* fixed light-emission period for G light emitter; 11*b*, 21*b* fixed light-emission period for B light emitter; 12*r*, 22*r* variable light-emission period for R light emitter; 12*g*, 22*g* variable light-emission period for G light emitter; 12*b*, 22*b* variable light-emission period for B light emitter; 31 light source, 311 R light emitter; 312 G light emitter; 313 B light emitter; 32, 32A illuminating unit; 321 R illuminating unit; 322 G illuminating unit; 323 B illuminating unit; 33, 33A image display unit; 34, 34A image signal analyzer; 341, 341A light-emission period generator; 3411 maximum value detector; 3412, 3412A light-emission period converter; 3413 control signal generator; 342 image data corrector; 3421 coefficient calculator; 3422 display light intensity converter; 3423 coefficient multiplier; 3424 image data converter; 35 light source controller; 351 correction signal calculator; 352 light-emission drive signal generator; 353 light-detection period signal generator; 36, 36A light detector; 36Ar, 36Ag, 36Ab sensor; 37 peak value corrector; reference peak value memory; 391 R modulator; 392 G modulator; 393 B modulator; 40 color image synthesizer; Dr light-emission drive signal for R light emitter; Dg light-emission drive signal for G light emitter; Db light-emission drive signal for B light emitter; Tr light-emission period for R light emitter; Tg light-emission period for G light emitter; Tb light-emission period for B light emitter; $T_{Fr}$ fixed light-emission period for R light emitter; $T_{Fg}$ fixed light-emission period for G light emitter; $T_{Fb}$ fixed light-emission period for B light emitter.

What is claimed is:

1. An image display apparatus comprising:

a light source having a plurality of light emitters, each of the plurality of light emitters, whose light-emission period is controlled separately, emitting one color of a plurality of colors;

an image signal analyzer for analyzing a plurality of color image data included in an input image, and for determining a timing of light emission for each of the plurality of light emitters;

a light source controller for generating light-emission drive signals based on the light emission timings for the respective plurality of light emitters, and for controlling light-emission periods of the light source;

an illuminating optical system for generating substantially uniform illumination light from the light emitted from each of the plurality of light emitters of one color of the plurality of colors;

an image display unit for modulating, pixel by pixel, the illumination light of the plurality of colors, to form a display image;

a light detector for detecting the light emitted from each of the plurality of light emitters of the light source, and for outputting an average light-emission peak value for each of the plurality of light emitters;

a reference peak value memory for storing, as reference peak values, reference values of the light-emission peak values for the respective light emitters; and a peak value corrector for generating a correction value such that the average light-emission peak value of each light emitter is equal to the corresponding reference peak value;

wherein each of said light emission periods includes a fixed light-emission period of a fixed length regardless of the value of the corresponding color image data;

the light source controller generates the light-emission drive signals, each of the light-emission drive signals has a length of the fixed-light emission period when the light emission timing has a length shorter than the fixed light-emission period; and the light detector detects the light emitted during each of the fixed light-emission periods, and outputs the average light-emission peak value which is obtained by determining a time integral of the intensity of light emitted from the corresponding light emitter during the corresponding fixed light-emission period.

2. The image display apparatus of claim 1, wherein the light source controller corrects the peak value of each of the light-emission drive signals for the light emitter, based on the corresponding correction value.

3. The image display apparatus of claim 1, wherein the image display unit includes a reflection-type image display element, having micromirrors corresponding in number to the pixels, for modulating the illumination light.

4. The image display apparatus of claim 1, wherein the image signal analyzer sets, within each frame period, a turn-off period, in which the light emitters are not turned on, while all the pixels in a screen are not used for displaying an image.

5. The image display apparatus of claim 1, wherein the light source controller generates drive signals by which the light-emission periods of the light emitters of the plurality of colors are controlled not to overlap each other.

6. The image display apparatus of claim 1, wherein the image signal analyzer determines the light-emission periods of the light emitters to be allocated in proportion as the respective colors of the image data.

7. The image display apparatus of claim 1, wherein the image signal analyzer comprises:

a light-emission period generator for determining the timing of light-emission for each light emitter, so that the light-emission period, decided from the maximum value of the color image data, corresponding to the light emitter, included in the image data of each frame, is made to be the fixed light-emission period when the length of the light-emission timing is shorter than the fixed light-emission period, and for generating a light-emission period control signal representing the timing having been determined; and an image data corrector for correcting the color image data for each pixel, depending on the light-emission periods of the respective light emitters, to generate a display image signal.

8. The image display apparatus of claim 1, wherein the image display unit comprises:

a plurality of optical modulation units, each of which is provided for each of the light emitters, for modulating the light emitted from the light source; and a synthesizer for synthesizing the light modulated by the plurality of optical modulation units.

9. The image display apparatus of claim 1, wherein the image display unit modulates the illumination light by means of a transmission type optical modulation device.

10. An image display apparatus comprising:

a light source having a plurality of light emitters, the light emitting period of each of the plurality of light emitters is controlled separately;

an image signal analyzer for analyzing an image data of an input image, and for determining a timing of light emission for each of the plurality of light emitters;

a light source controller for generating light-emission drive signals based on the light emission timings for the respective plurality of light emitters, and for controlling light-emission periods of the light source;

an illuminating optical system for generating substantially uniform illumination light from the light emitted from the plurality of light emitters;

an image display unit for modulating, pixel by pixel, the illumination light, to form a display image;

a light detector for detecting the light emitted from each of the plurality of light emitters of the light source, and for outputting an average light-emission peak value for each of the plurality of light emitters;

a reference peak value memory for storing, as reference peak values, reference values of the light-emission peak values for the respective light emitters; and a peak value corrector for generating a correction value such that the average light-emission peak value of each light emitter is equal to the corresponding reference peak value;

wherein each of said light emission periods includes a fixed light-emission period of a fixed length regardless of the value of the image data;

the light source controller generates the light-emission drive signals, each of the light-emission drive signals having a length of the fixed-light emission period when the light emission timing has a length shorter than the fixed light-emission period; and the average light-emission peak value is an average value obtained by determining a time integral of the intensity of light emitted during the corresponding fixed light-emission period.

* * * * *